US007537439B2

(12) United States Patent
Pohler

(10) Patent No.: US 7,537,439 B2
(45) Date of Patent: May 26, 2009

(54) TRANSFER PUMP

(75) Inventor: Donald M. Pohler, Rochester, NY (US)

(73) Assignee: Liberty Pumps Inc., Bergen, NY (US)

( * ) Notice: Subject to any disclaimer, the term of this patent is extended or adjusted under 35 U.S.C. 154(b) by 719 days.

(21) Appl. No.: 10/824,724

(22) Filed: Apr. 15, 2004

(65) Prior Publication Data

US 2005/0232796 A1 Oct. 20, 2005

(51) Int. Cl.
*F04B 35/04* (2006.01)
*F01D 25/16* (2006.01)
*H02K 9/06* (2006.01)

(52) U.S. Cl. ..... 417/423.11; 417/423.8; 415/109; 415/111; 310/62

(58) Field of Classification Search ..... 310/62, 310/63; 415/111, 204, 109, 230, 231; 417/423.1, 417/423.8, 423.11
See application file for complete search history.

(56) References Cited

U.S. PATENT DOCUMENTS 2,312,525 A * 3/1943 Curtis ..... 417/423.11
2,900,919 A * 8/1959 Anderson et al. ..... 415/111
3,644,061 A * 2/1972 McFarlin ..... 415/111
4,162,419 A * 7/1979 DeAngelis ..... 310/62
4,569,638 A * 2/1986 Harker et al. ..... 417/423.11
5,248,238 A * 9/1993 Ishida et al. ..... 415/55.1
5,375,651 A * 12/1994 Colwell ..... 417/423.8
5,865,597 A * 2/1999 Ozawa ..... 415/109
6,464,471 B1 * 10/2002 Mathis et al. ..... 417/423.8
6,471,476 B1 10/2002 Diels et al.
6,524,085 B2 * 2/2003 Shoda et al. ..... 417/423.14
6,695,576 B2 * 2/2004 Rosso et al. ..... 417/423.11
2001/0014290 A1 * 8/2001 Takura et al. ..... 417/423.8

OTHER PUBLICATIONS

AMT 3" Self-Priming Centrifugal Pumps, pp. 25-26, sales literature # 287X-CP / 0901, AMT, Royersford, PA, USA.
Self-Priming Washdown Pump, amazon.com website, http://www.amazon.com/exec/obidos/ASIN/B0000AYF8K/inktomisg-20/ref%3Dnosim/102-7784242-8174565.
AMT Self-Priming Cast Iron Centrifugal Pump, pp. 21-22, sales literature # 285X-CP-0901, AMT, Royersford, PA, USA.
Self-Priming Centrifugal Pump, moniba.net website, http://www.moniba.net/indus2.htm.
Mityflex Peristaltic Pumps, ankoproducts.com website, http://www.ankoproducts.com/self_priming_pumps.html.
Ebara Pro-Steel Self Priming Pump, www.pumps-direct.com website, http://www.pumps-direct.com/self-pri.htm.
Zoeller Pump co. "High Capacity" Water Mover, www.zoeller.com website, http://www.zoeller.com/zcopump/products/sumpeff/314.htm.
½ HP Portable Electric Utility Pump, waynepumps.com website, http://www.waynepumps.com/products/print.php?PC4.

(Continued)

*Primary Examiner*—Charles G Freay
(74) *Attorney, Agent, or Firm*—Patent Innovations LLC; John M. Hammond

(57) ABSTRACT

A portable self-priming transfer pump comprising a one piece unitary housing, comprised of a first portion that houses a motor, a second casing portion within which is formed a pump cavity, and a handle; and a one piece cover fitted to the outboard end of the second portion of the housing.

48 Claims, 19 Drawing Sheets

OTHER PUBLICATIONS

Pony Pump 115V 360 GPH Self-Priming, Model# 50AC110B, northerntool.com website, http://www.northerntool.com/webapp/wcs/stores/servlet/ProductDisplay?catalogId=4006970&storeId=6970&productID=16818&langId=-1.

* cited by examiner

TRANSFER PUMP

This invention relates in one embodiment to a liquid pump, and more particularly to a general liquid transfer pump having self-priming and seal self-lubricating capabilities.

FIELD OF THE INVENTION

Portable liquid pumps for transfer of water or other liquids in temporary circumstances.

BACKGROUND OF THE INVENTION

Centrifugal pumps are widely used in a variety of fluid transport applications. A rotating impeller is driven by an internal or external power source, drawing liquid into a pump chamber, and expelling liquid therefrom at increased pressure. In the most typical configuration, liquid flows into an axial inlet of the impeller, is forced by the impeller through a toroidal flow path formed by a volute surrounding the impeller, and is discharged from the volute and out of the pump.

Access to the interior of the volute and the impeller is occasionally needed, for inspection, repair, or to clear out debris trapped between the volute and impeller. The latter instance is somewhat common wherein the pump is used in a temporary application, such as e.g., emptying a water heater, draining a swimming pool cover, or irrigation. Such water is often somewhat dirty and may contain pieces of solid material such as grit, scale, small wood scraps, or construction debris. It is preferable that such a pump be easy to partially dismantle at the installed location, without disconnecting the pump from the piping, drive motor and/or wiring thereto, or removing the entire assembly to a remote location for service.

It is also preferable that such a pump be "self priming", in that there is often a need to install such a pump in a location that is above the level of the liquid to be pumped. Hence, one cannot rely upon gravity-driven flow to flood the inlet of the pump and thereby prime the pump. Self-priming capability is typically accomplished by providing fluid passageways in the pump that result in recirculation of a small amount of liquid through the volute of the pump, until the "prime", i.e. the complete filling of the volute with liquid phase, is accomplished or re-established. During this period of recirculation, air or any other gas present that is drawn into the pump inlet is caused to move through the volute and out through the discharge outlet of the pump.

In general, self priming centrifugal pumps incorporate a recirculation port in the volute that is too small to deliver to the impeller all of the water that it is capable of discharging. With the pump impeller being "starved" for adequate liquid, the air (or other gas present) is drawn from the suction opening of the pump by the impeller. The resultant mixture of froth (gas and water) is repeatedly discharged by the impeller and into the surrounding pump chamber. The froth in the pump chamber separates so that the majority of the gas is discharged from the outlet of the pump chamber. The liquid returning to the recirculation port by gravity therefore is relatively free of gas. This liquid is mixed, entrained, and/or otherwise dispersed with more gas flowing in through the pump inlet, and the resulting froth is discharged out through the volute whereupon it separates into liquid and gas. The pump effectively becomes an air pump temporarily, moving air in the pump inlet, and out the pump outlet, while repeatedly recirculating liquid contained in the pump chamber. This cycle continues until a continuous flow of liquid is established at the pump inlet, containing substantially no entrained gas.

During the period of time when "self priming," i.e. internal recirculation is occurring, there is a risk that heat buildup may occur within the pump volute and chamber. Of particular concern is the buildup of heat at the pump shaft seal, where a thin film of liquid provides lubrication between a rapidly rotating first surface, and a stationary second surface. Current self-priming centrifugal pumps in general do not provide prolonged wetting, cooling, and lubrication of the pump shaft seal, and failure thereof during a prolonged period of self priming is a problem.

Portable transfer pumps are also often exposed to a variety of adverse environmental conditions, such as heat, cold, and rain or snow. Such pumps are further subjected to generally rough handling, being repeatedly moved from job site to job site, often unprotected and exposed to the elements. Finally, since the use of such pumps is in applications that are not high precision, high "value added" tasks, it is necessary that such pumps be made inexpensively in order to sell at a relatively low price.

U.S. Pat. No. 6,471,476 of Diels et al., issued Oct. 29, 2002, discloses a centrifugal trash pump comprising a volute and an impeller that are disposed in a pump chamber accessible through an access opening in the front wall of the pump casing. The access opening is closed by a cover attachable to the front wall of the casing. The volute is attached to the cover by fasteners accessible from the outside of the cover so as to permit the cover and volute to be removed either as a unit or individually, with the cover being removed first, followed by the volute. The entire disclosure and figures of U.S. Pat. No. 6,471,476 is incorporated herein by reference.

The pump of Diels et al. does provide self-priming capability, and the ability to easily access the impeller and interior of the volute therein. However such pump comprises a rather complex multi-piece casing, volute, and cover assembly and combination of fasteners that is quite likely expensive to manufacture. The disclosure of Diels et al. is silent with regard to lubrication and cooling of the pump shaft seal during prolonged periods of self-priming.

There is therefore a need for a simple portable transfer pump that will reliably operate in self priming mode for a prolonged period, that has a simple, easily and inexpensively manufactured construction, that is resistant to adverse environmental conditions, and that is easy to service, maintain, and/or repair.

It is therefore an object of this invention to provide a portable transfer pump that can operate in self priming mode for prolonged time periods without damage to the pump shaft seal.

It is an object of this invention to provide a portable transfer pump that provides adequate cooling and lubrication to the pump shaft seal during regular and during self priming operation.

It is a further object of this invention to provide a portable transfer pump that provides superior cooling of the motor thereof during operation.

It is another object of this invention to provide a portable transfer pump that comprises a simple, one-piece housing that is of high strength and primarily of cast construction.

It is an object of this invention to provide a portable transfer pump that is aesthetically attractive and substantial in appearance.

It is a further object of this invention to provide a portable transfer pump with easy access to the impeller and volute thereof.

It is a further object of this invention to provide a portable transfer pump having an electrical switch incorporated therein, and a long power cord attached thereto.

It is a further object of this invention to provide a portable transfer pump with a housing having a pump cavity filling funnel incorporated therein.

It is a further object of this invention to provide a portable transfer pump with a plug engaged with a pump cavity filling funnel, and requiring no tools for removal of such plug from such filling funnel.

It is a further object of this invention to provide a portable transfer pump to which can be fitted common pipe and/or hose fittings.

It is a further object of this invention to provide a portable transfer pump comprising a large handle cast into the housing that renders the pump well balanced to assist in transportation thereof.

It is a further object of this invention to provide a portable transfer pump having a unitary multi-functional housing cover that serves to replace a large number of related parts needed in a typical pump.

It is a further object of this invention to provide a portable transfer pump wherein the critical components thereof are well protected from adverse elements and rough handling.

It is a further object of this invention to provide a portable transfer pump that is lightweight.

It is a further object of this invention to provide a portable transfer pump that is portable and is certified for outdoor use by various certifying and regulatory agencies and government entities.

It is a further object of this invention to provide a portable transfer pump having an integrally molded fastener in the impeller thereof.

SUMMARY OF THE INVENTION

In accordance with the present invention, there is provided a portable transfer pump comprising a unitary housing; a motor disposed within a first portion of said housing, said motor comprising a rotatable drive shaft; a pump cavity formed in a second portion of said housing, said cavity having an open end and an outlet port; a volute chamber having an open end, said volute chamber formed within said pump cavity; a rotatable impeller disposed within said volute chamber and operatively engaged with said rotatable drive shaft of said motor; and a cover attached to said open end of said pump cavity and engaged with said open end of said volute chamber to form a volute.

In accordance with the present invention, there is provided a portable transfer pump comprising a unitary housing; a motor disposed within a first substantially cylindrical portion of said housing; said first portion of said housing comprising an open end, a first air inlet opening and a first air outlet opening; a pump cavity formed in a second portion of said housing; and a cover attached to said open end of said first portion of said housing.

In accordance with the present invention, there is provided a portable transfer pump comprising a unitary housing; a motor disposed within a first substantially cylindrical portion of said housing; said first substantially cylindrical portion of said housing comprising an open end, and a first air outlet opening; a pump cavity formed in a second portion of said housing; and a cover attached to said open end of said first portion of said housing, said cover comprising an outer surface, an inner surface, and a first inlet opening.

BRIEF DESCRIPTION OF THE DRAWINGS

The invention will be described by reference to the following drawings, in which like numerals refer to like elements, and in which.

Figure 1:
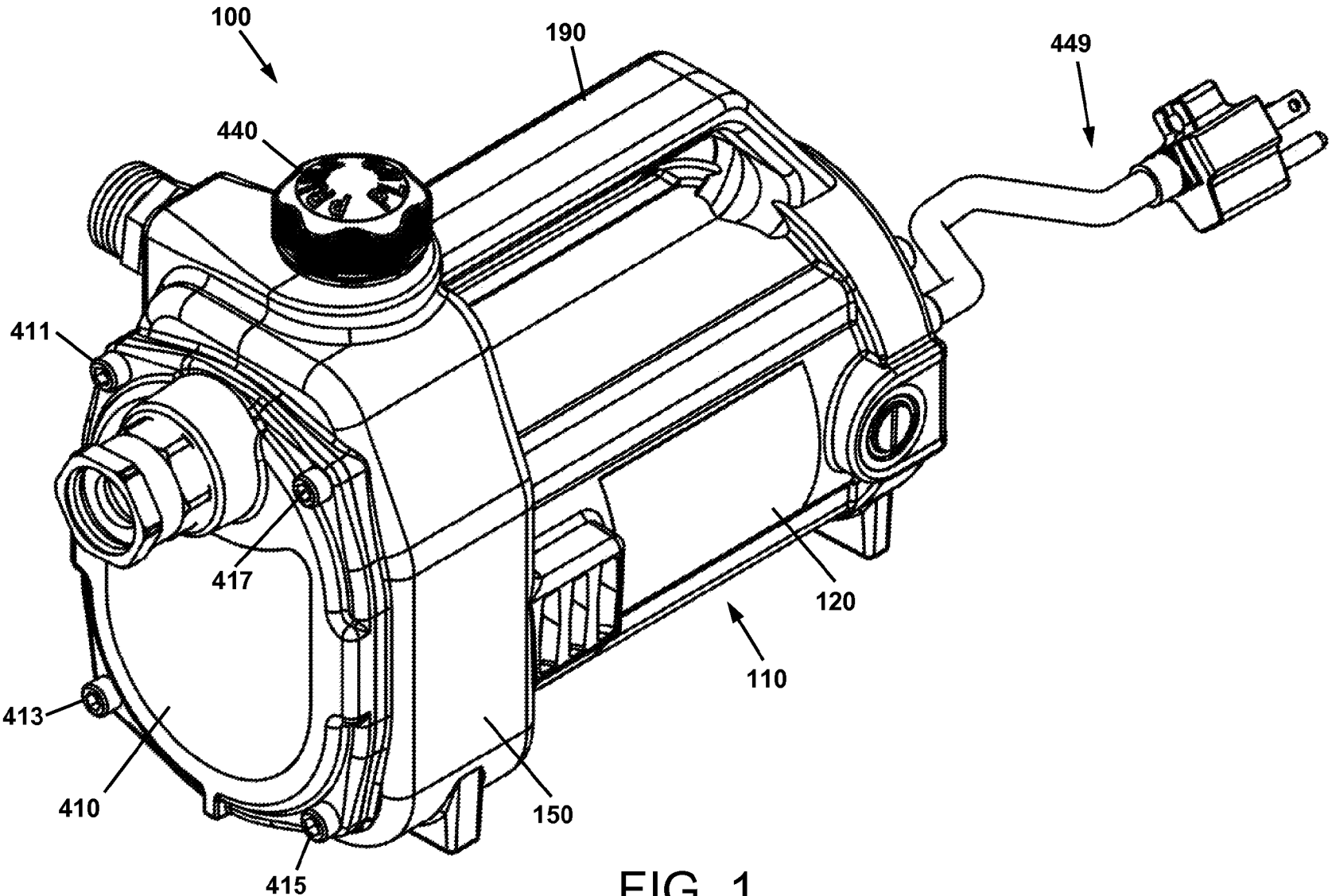
FIG. 1 is a perspective view of one embodiment of the transfer pump of the present invention.
Figure 2:
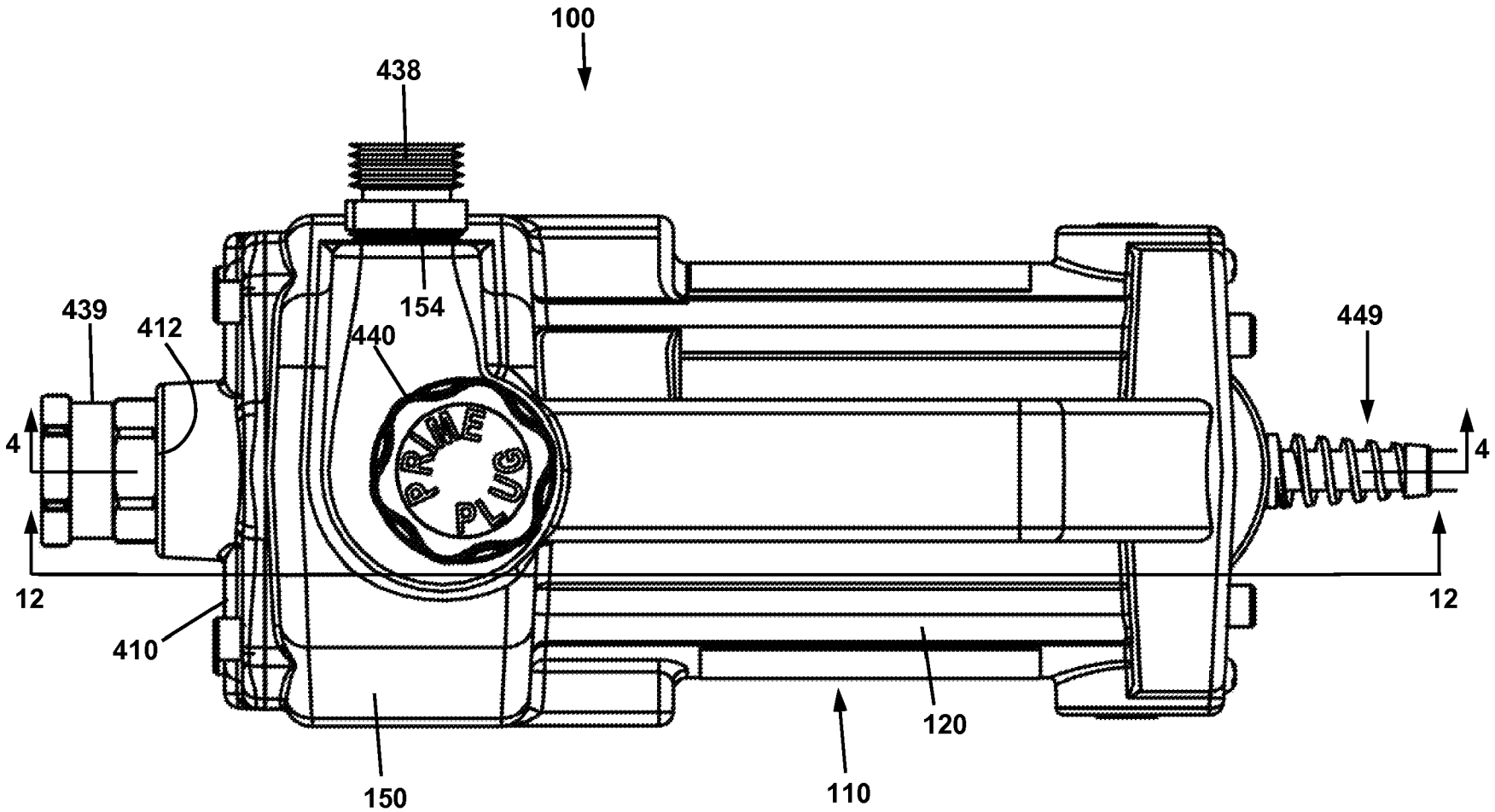
FIG. 2 is a top view of the transfer pump of FIG. 1.
Figure 3:
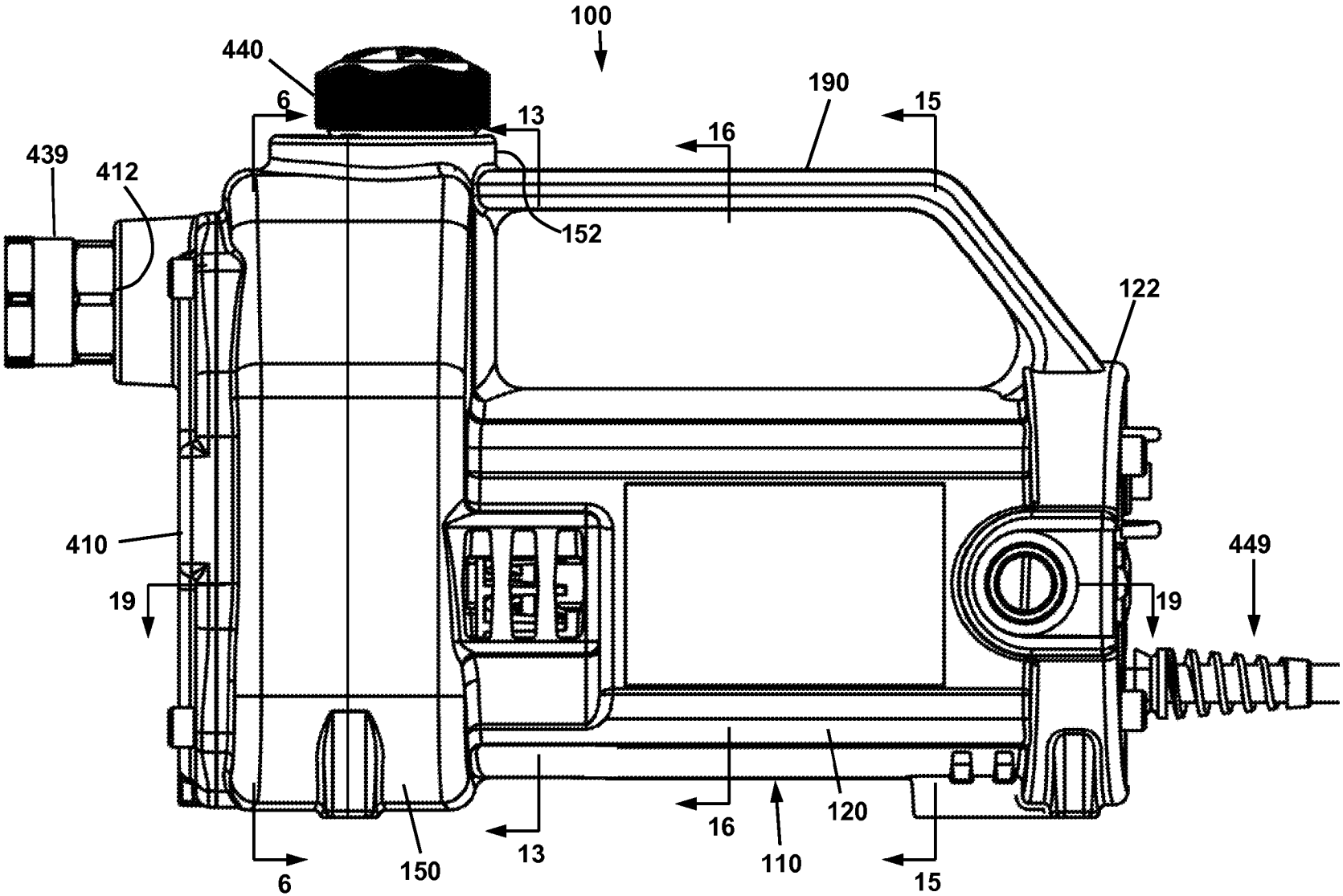
FIG. 3 is a side elevation view of the transfer pump of FIG. 1.
Figure 4:
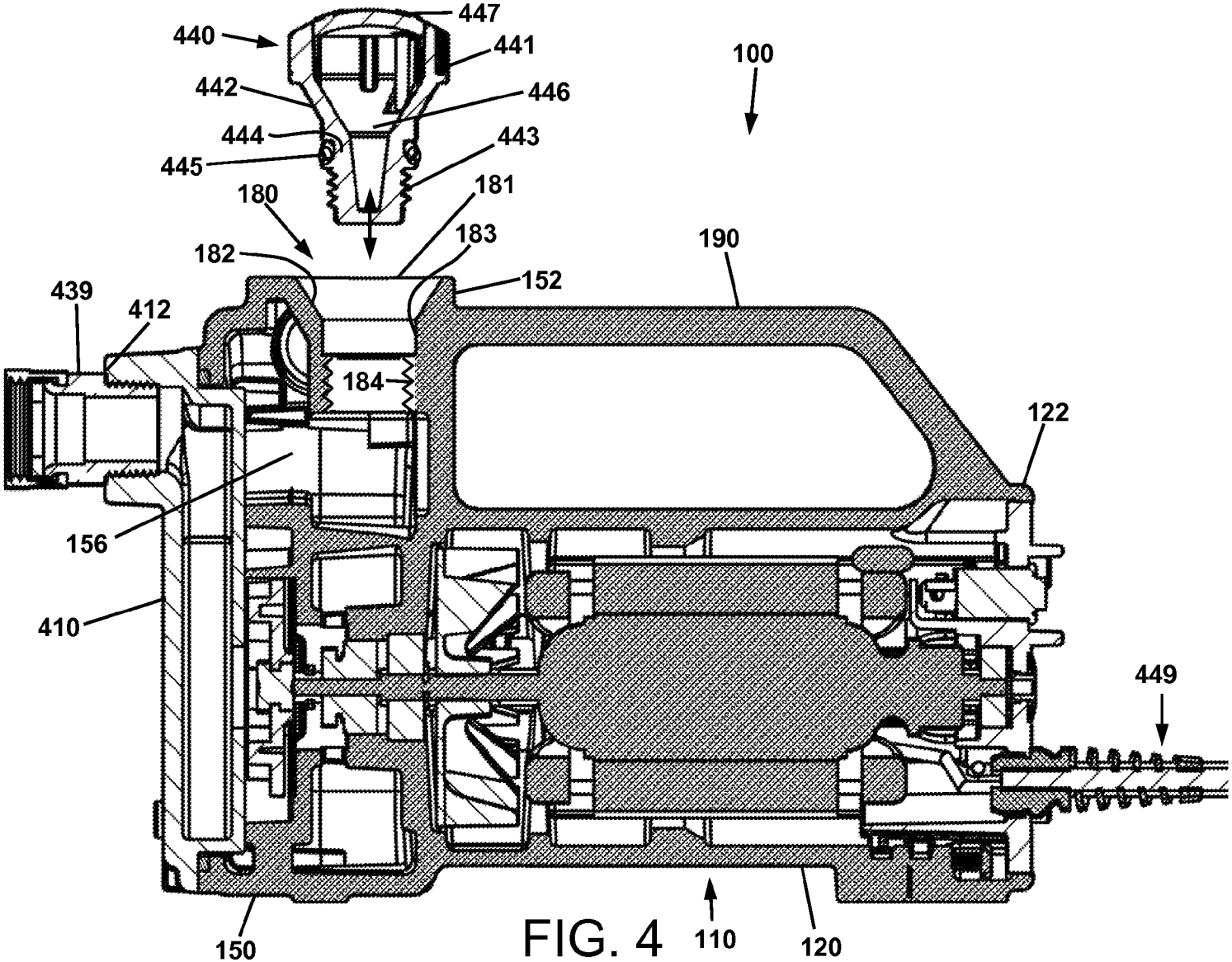
FIG. 4 is a side cross sectional view of the transfer pump of FIG. 1, taken along line 4-4 of FIG. 2.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a perspective view of one embodiment of the transfer pump of the present invention. Referring to FIGS. 1 through 4, transfer pump 100 comprises a one piece i.e. unitary housing 110, a cover 410, a filler cap 440, and an electrical cord assembly 449. Housing 110 comprises a first portion 120 that is generally cylindrical and that houses a motor, a second casing portion 150 within which is formed a pump cavity, and a handle 190 that extends from an upper edge 122 of the first portion 120 to an upper edge 152 of the second portion 150 of the housing 110.

In operation of pump 100, fluid is taken in through inlet 412 in cover 410, and is discharged through outlet port 154 in pump casing 150. For the convenience of users, pump 100 is preferably provided with inlet fitting 439 and outlet fitting 438, which are threadedly and sealingly engaged with tapped threads (e.g. NPT pipe threads) in ports 412 and 154, respectively.

In the preferred embodiment, unitary housing 110 is formed of aluminum alloy and is made by a casting process. In other embodiments, housing 110 may be made of high strength polymers and/or polymer/fiber composites or other suitable materials that may be cast, molded, and/or machined.

Figure 5:
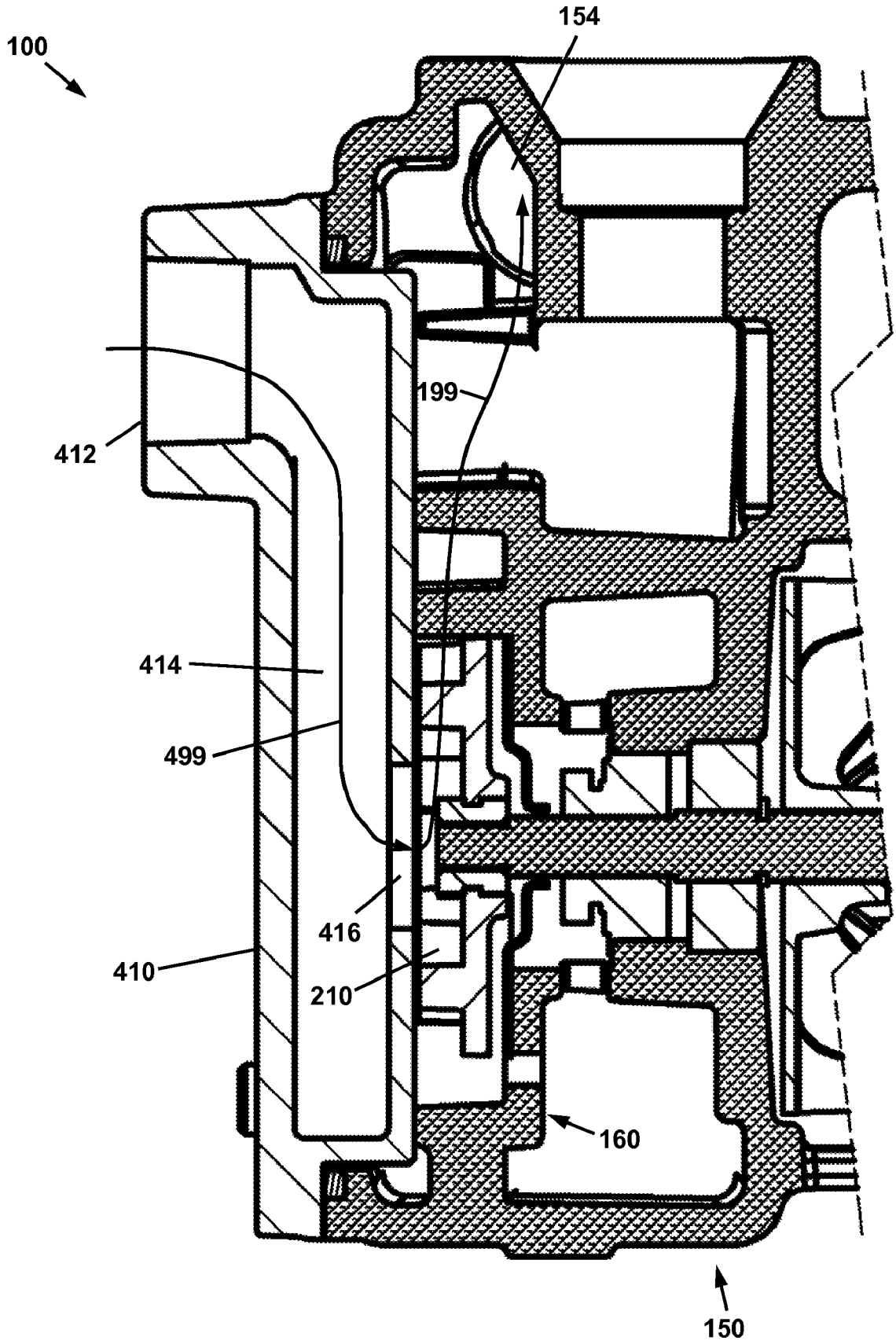
FIG. 5 is a detailed cross sectional view of the pump cavity depicted in FIG. 4, indicating the general flow of liquid therethrough during steady state pump operation.
Figure 6:
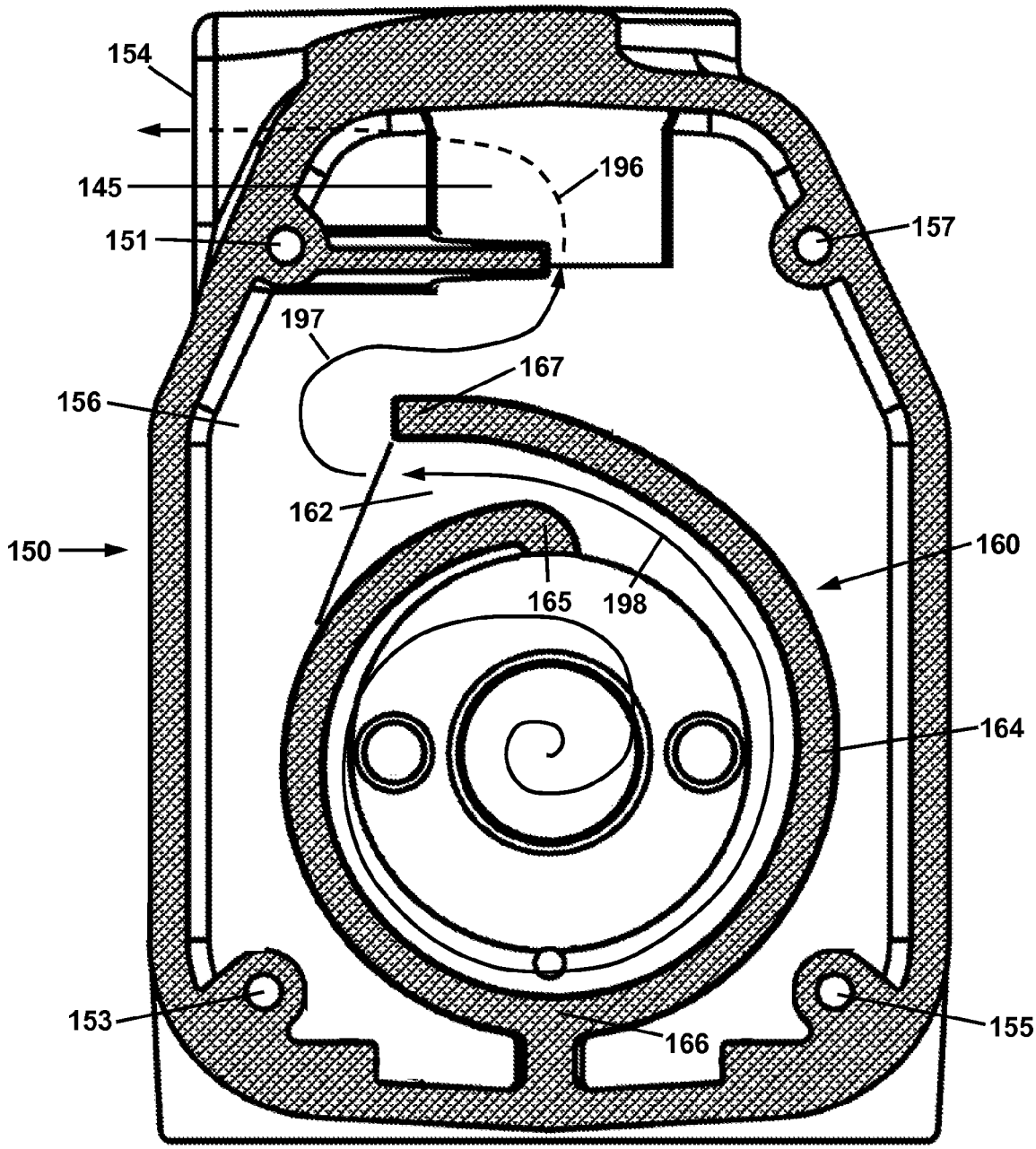
FIG. 6 is a cross sectional view of the pump cavity of the pump housing during steady state pump operation, taken along line 6-6 of FIG. 3.
Figure 7C:
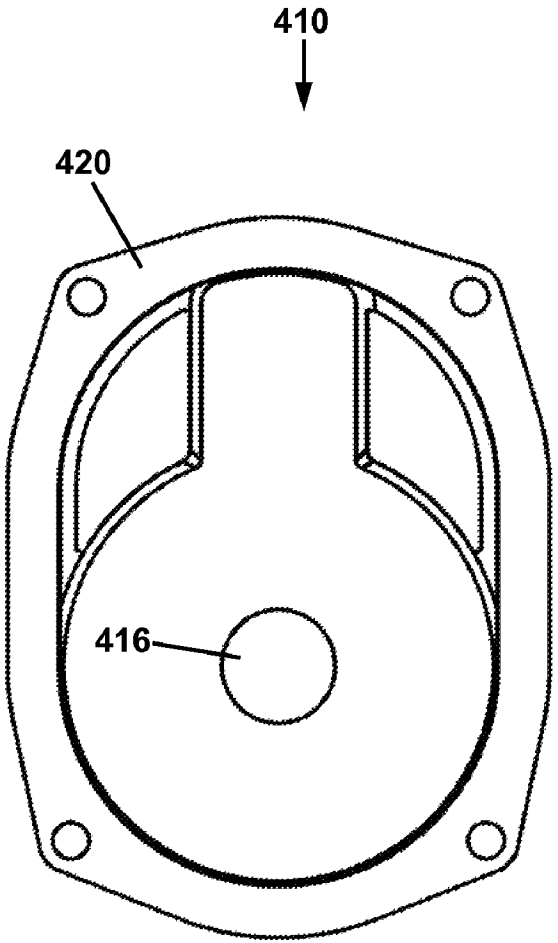
FIGS. 7A, 7B, and 7C are outside, side, and inside elevation views of the cover of the pump.
Figure 7B:
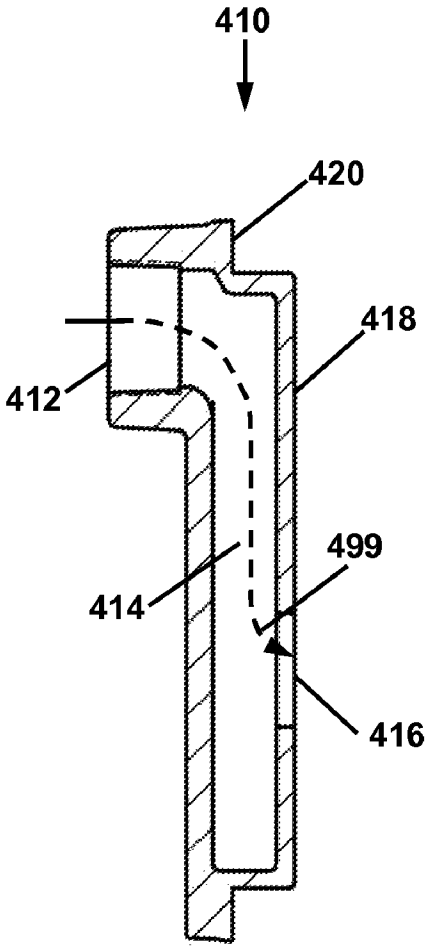
Figure 7A:
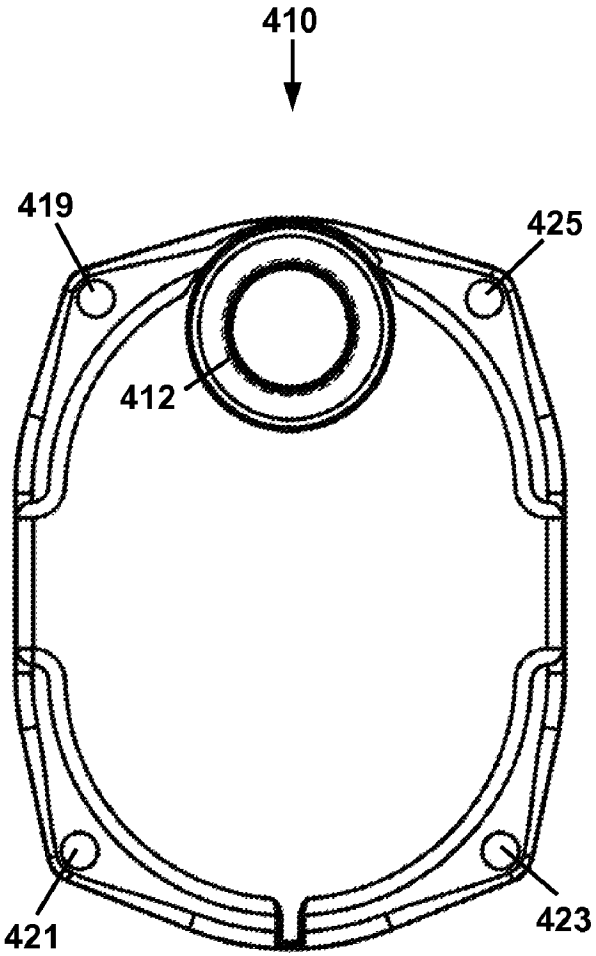
Figure 8:
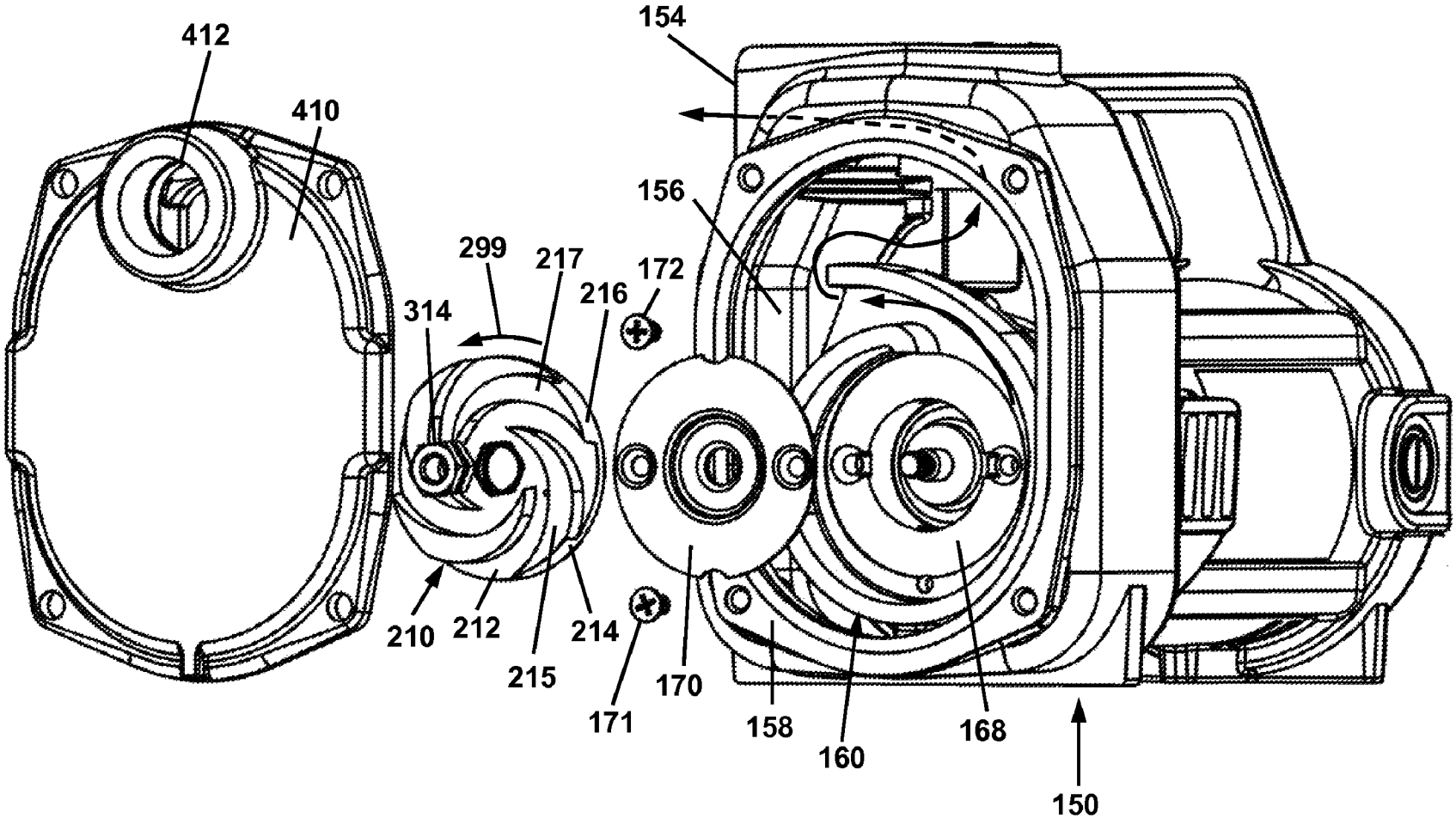
FIG. 8 is a perspective view of an exploded assembly of the pump of FIG. 1, depicting key components thereof.

FIG. 5 through FIG. 8 provide further details of the pumping of a fluid by pump 100 during steady state operation thereof, i.e. not self-priming mode. FIG. 5 is a detailed cross sectional view of the pump cavity depicted in FIG. 4, indicating the general flow of liquid therethrough during steady state pump operation. FIG. 6 is a cross sectional view of the pump cavity of the pump housing, taken along line 6-6 of FIG. 3. FIGS. 7A, 7B, and 7C are outside, side, and inside elevation views of the cover of the pump. FIG. 8 is a perspective view of an exploded assembly of the pump of FIG. 1, depicting key components thereof. For the sake of simplicity of illustration, the pump assembly depicted in FIG. 6 is shown without the pump impeller in place.

Referring first to FIGS. 5 and 7B, in steady state operation, fluid consisting of substantially all liquid phase (i.e. containing a negligible amount of gas bubbles) enters pump 100 through inlet port 412 in cover 410. Fluid follows a flow path 499 through a cavity 414 in cover 410, and exits cover 410 through cover outlet port 416 into pump volute 169 proximate to the central area, axis or eye of impeller 210. It is to be understood that as used herein, the term "flow path" is meant to indicate an average path in the general vicinity of the particular trajectory depicted in any given Figure. The term "flow path", and associated flow trajectories depicted in the Figures are not meant to be limited to the precise paths depicted in such Figures. It will be apparent that variations in such paths occur due to flow turbulence in 3D space, and other fluid flow effects. Any given flow path depicted in a Figure is meant to indicate an average or general result, indicating flow from one region to another region, as depicted by a curve ending with an arrowhead.

Referring again to FIG. 5, fluid is pumped by pump 100 along the flow path 199 within pump casing 150, and is discharged from outlet port 154 in pump casing 150. Referring to FIG. 6, flow path 199 within pump casing 150 is depicted in more detail. Fluid is first accelerated from axial flow into the eye of impeller 210 by the spinning action 299 (see FIG. 8) thereof, resulting in a generally cycloidal trajectory 198, wherein the fluid is discharged tangentially from impeller 210, and flows out from exit flare 162 of volute chamber 160 and volute 169 into main cavity 156 of pump casing 150. The fluid then flows generally along path 197 within main cavity 156, and then along path 196 within outlet passageway 145, whereupon the fluid is discharged at outlet 154.

Certain features are provided to make pump 100 highly efficient in the pumping of liquid, while also making pump 100 simple to service and maintain. Referring to FIG. 1, FIG. 7A, and FIG. 6, cover 410 is secured to pump casing 150 by screws 411, 413, 415, and 417, which are engaged with threaded holes 151, 153, 155, and 157 through holes 419, 421, 423, and 425 in cover 410. In one embodiment screws 411 et seq. are socket head cap screws, although numerous other common threaded fasteners, such as slotted, Phillips, hex head, Torx®, and the like would be suitable. Such screws are easily removed from pump 100 at its location of service, thereby enabling quick access to the main cavity 156, volute chamber 160, impeller 210, and other pump components within pump cavity 150. In a preferred embodiment, the pattern of threaded holes 151 et seq. is asymmetric, so that cover 410 can only be fastened to casing 150 in one orientation, thereby preventing any error in the reassembly of pump 100 after removing cover 410.

In order for pump 100 to run with high efficiency, certain dimensional relationships must be maintained between key parts thereof. Referring to FIGS. 7B and 7C, pump cover 410 is provided with a flat inner face 418, and a mounting flange 420 around the perimeter thereof. Flange 420 and face 418 define planes that are substantially parallel to each other.

Referring again to FIG. 8, certain features of a preferred impeller of the pump 100 can be seen. Preferred impeller 210 comprises a base flange 212 upon which are formed a plurality of vanes, e.g. vanes 214 and 216. Vanes 214 and 216 (and others if present) each comprise an outer face, e.g. faces 215 and 217, respectively. Faces 215 and 217 are formed with a precision flat surface that is substantially perpendicular to the axis of rotation of impeller 210, such rotation being indicated by arrow 299. With such a dimensional arrangement, the axial runout of faces 215 and 217 (and others if present) is minimized. Faces 215, 217, and others present are coplanar, such that faces 215, 217, etc. define a plane or overall vane face that is perpendicular to the axis of rotation of impeller 210. In general, it is preferable that impeller faces 215/217 have an axial runout of less than about 0.006 inch, and more preferably less than about 0.003 inch. Such minimal runout and coplanarity of faces 215, 217, etc. are important in providing a pump of high efficiency, as will be explained presently.

In one preferred embodiment, impeller 210 consists essentially of a polymer-glass fiber composite material, and in particular, of Lupox 5303, which is a glass fiber reinforced PBT Polybutylene Terephthalate, with the exception of mounting nut 314. Impeller 210 is preferably injection molded in one piece, and formed such that mounting nut 314 is encased therein. The tooling for manufature of impeller 210 is preferably sufficiently precise so as to require no secondary material removal therefrom to achieve final dimensions, i.e. impeller 210 is made at net shape.

Figure 9:
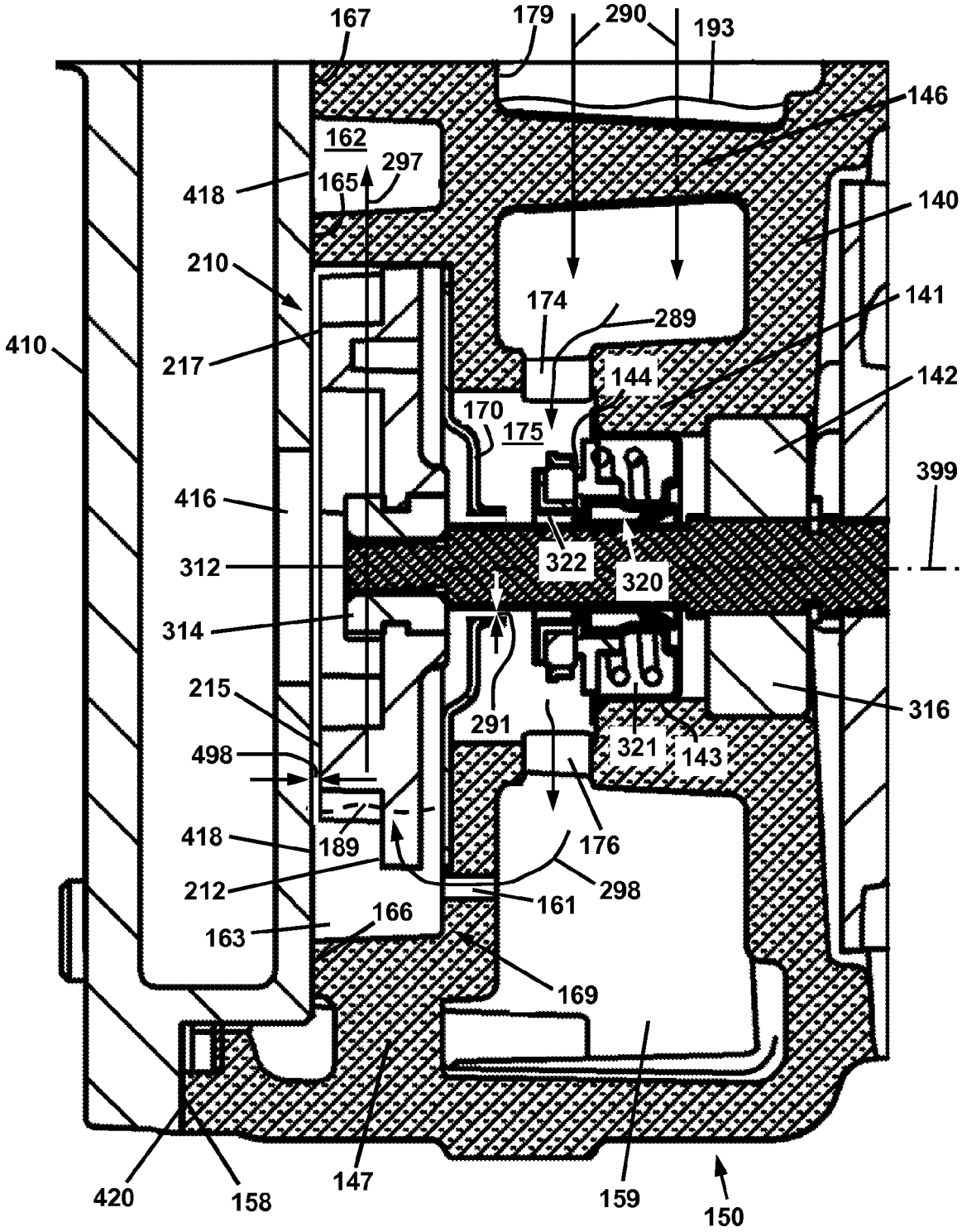
FIG. 9 is an enlarged cross sectional view of the pump cavity depicted in FIG. 5, showing additional detail within the pump volute, as well as liquid flow that occurs during self-priming operation.

FIG. 9 is an enlarged cross sectional view of the pump cavity depicted in FIG. 5, showing additional detail within the pump volute. Referring to FIG. 9, cover 410 is shown fastened to casing 150, as would be the case when the pump is operating. Impeller 210 is operably joined to motor shaft 312 by nut 314. The motor (not shown) of pump 100 is mounted in housing 120 (see FIG. 1) with the central axis 399 of motor shaft 312 therein being precisely aligned such that the plane defined by impeller faces 215, 217, etc. is substantially parallel to face 418 of cover 410. The running clearance 498 between face 418 and faces 215/217 is preferably between about 0.01 and about 0.04 inch, and more preferably between about 0.01 and about 0.02 inch. Faces 215/217 having minimal runout as described above enable such small running clearances, and thereby enable high pump efficiency, since very little liquid can pass through the running clearance, and thus substantially all of the liquid is accelerated by the vanes of the impeller.

An additional feature that enables high pump efficiency is the sealing contact that occurs between the inner face 418 of cover 410 and the open end 164 or face 164 of the volute chamber 160 to form overall volute 169. Referring to FIG. 6, volute chamber 160 comprises a cycloidal open end or face 164, with a beginning region 165, a middle region 166, and an end region 167. Referring also to FIG. 9, volute flange face 164 is formed in pump casing 150 of housing 110 such that it defines a plane that is perpendicular to the central axis of motor shaft 312. Thus volute face 164 is parallel to the planes of impeller blade faces 215/217, cover inner face 418, and cover flange 420.

The cover flange 420 of cover 410 and the mating flange 158 (see FIG. 8) of pump casing 150 are dimensioned such that when cover flange 410 is fastened to pump casing 150, the inner surface 418 of cover 410 is placed in sealing contact with volute face 164 thereby forming volute 169, as indicated in FIG. 9. It can be seen that there is contact between beginning region 165, a middle region 166, and end region 167 of volute face 164 and inner surface 418 of cover 410. In this manner, no liquid is permitted to leak into the main cavity from the volute 169, and substantially all of the liquid is accelerated by the vanes of the impeller and discharged out exit flare 162 of volute 169. Thus high pump efficiency is attained.

The features of the pump of the present invention that enable it to operate in a "self priming" mode, while providing adequate lubrication and cooling to the shaft seal thereof will now be described. In general, self-priming of the pump at startup, or self-priming when there is an interruption in liquid flow to the pump (such liquid being replaced by air or other gas), is accomplished by providing fluid passageways in the pump cavity and volute thereof that result in recirculation of a small amount of liquid through the volute of the pump, until the "prime", i.e. the complete filling of the volute with liquid phase, is accomplished or re-established. During this period of recirculation, gas that is drawn into the pump inlet is caused to move through the volute and out through the discharge outlet of the pump.

It is to be understood that as the pump of the present invention is used most commonly for the transfer of liquids wherein the gas phase that is present is air, in the following discussion the term "air" is used generically, and not as a limitation. In the event that a gas other than air was present, the following description would still apply.

The particular fluid passageways in the pump cavity and volute of the pump of the present invention, which result in recirculation of a small amount of liquid through the volute of the pump until the "prime" is complete, are provided in a unique configuration that causes a constant supply of liquid to bathe and wet the pump shaft seal, such that lubrication and cooling of the seal is provided, thereby preventing the failure thereof.

In the event that no liquid is present in the pump cavity, such pump cavity must first be provide with a small amount of liquid to provide the recirculating function that was described previously. The pump cavity of the present invention is provided with means to introduce such liquid therein. Referring again to FIG. 4, priming liquid introduction means 180 comprises an open port 181 for introduction of liquid (not shown) into main cavity 156 of pump casing 150. Filling port 181 preferably comprises a frustoconical section 182, a counterbore 183, and a threaded bore 184. When liquid is being added manually into cavity 156, i.e. by pouring from a container or feeding from a hose, frustoconical section 182 acts as a funnel and provides ease of filling without spillage.

In one embodiment, pump 100 is further provided with filler plug 440, which is formed to mate with the funnel shape of port 181. Filler plug 440 comprises a body 441 having a conical taper 442 and a threaded shank 443, which engages with threaded bore 184 of casing 150. Plug 440 is preferably also provided with groove 444, to which is fitted O-ring 445, which sealingly fits in counterbore 183 when plug 440 is fitted in port 181. In a further embodiment, plug 440 is made with a hollow cavity 446, and is further provided with a snap fit cap 447 at the top thereof.

In other embodiments, priming liquid introduction means 180 may comprise a source of priming liquid operably connected to port 181, such as e.g. a hose, a bottle threadedly engaged with threaded bore 184. It will be apparent that the introduction of priming liquid through such priming liquid introduction means could be made to be supplied on an "as needed" basis.

Figure 10:
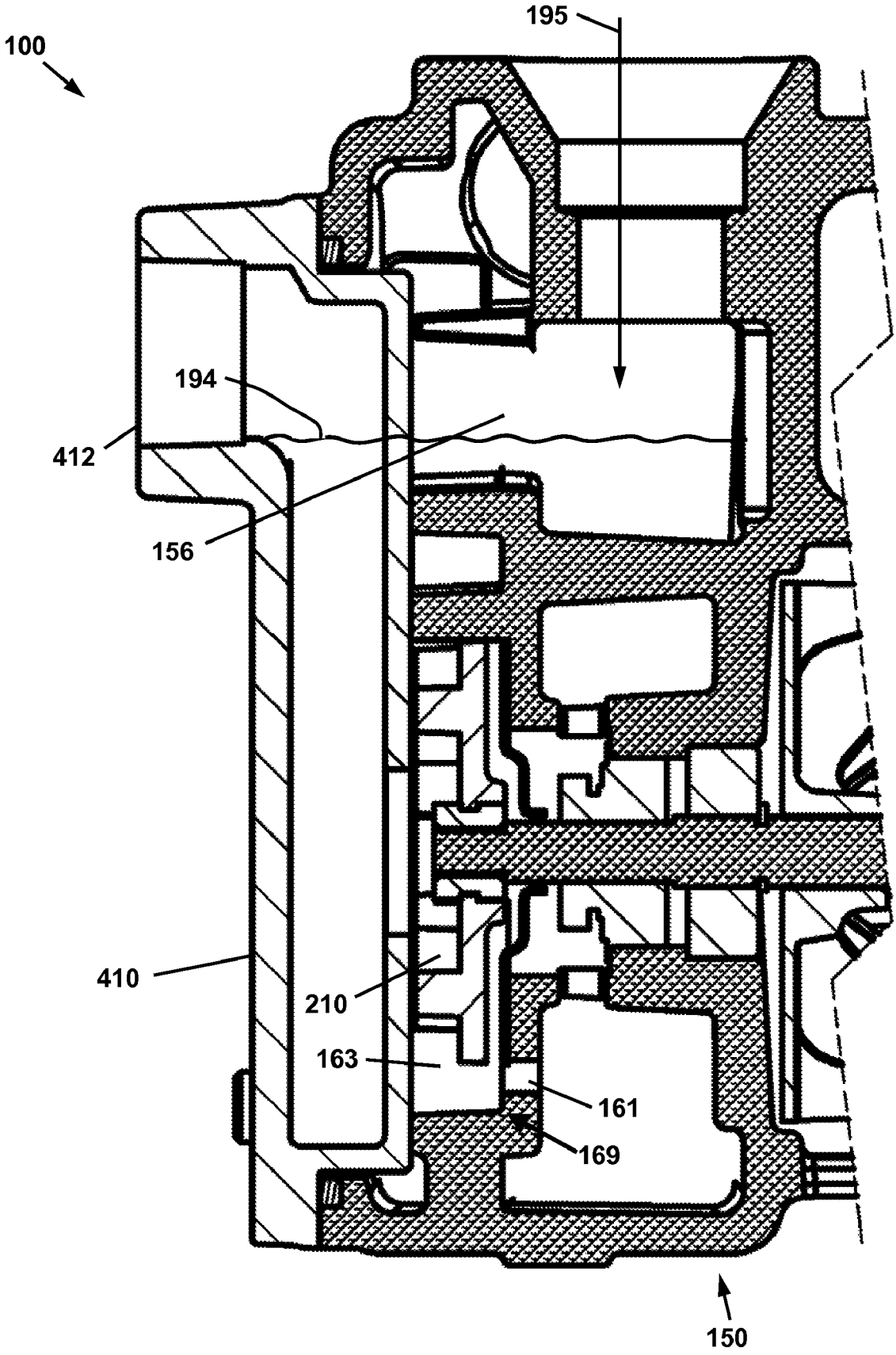
FIG. 10 is a detailed cross sectional view of the pump cavity depicted in FIG. 4, indicating liquid flow and level that occurs during self-priming operation.

At such time when self-priming is to occur, and there is a need to introduce priming liquid into cavity 156, such priming liquid is introduced through port 181. FIG. 10 is a detailed cross sectional view of the pump cavity depicted in FIG. 4, indicating liquid flow and level that occurs during self-priming operation. Referring to FIG. 10, when liquid is introduced into cavity 156 as indicated by arrow 195, such liquid will fill cavity 156 to at least level 194, which is the lower extremity of inlet port 412. Such liquid also fills the interior of volute 169, which is in communication with cavity 156 through at least one cross port 161 through the lower portion of the wall of volute chamber 160, thereby flooding and submerging impeller 210. Cross port 161 allows liquid flow from the lower portion 159 of pump casing 150 into the lower portion 163 of volute chamber 160. However, cross port 161 is sufficiently small so as to have a negligible effect on pump efficiency during steady state pumping operation, i.e. negligible flow occurs from the lower portion 163 of volute chamber 160 into the lower portion 159 of pump casing 150 during steady state pumping.

Figure 11:
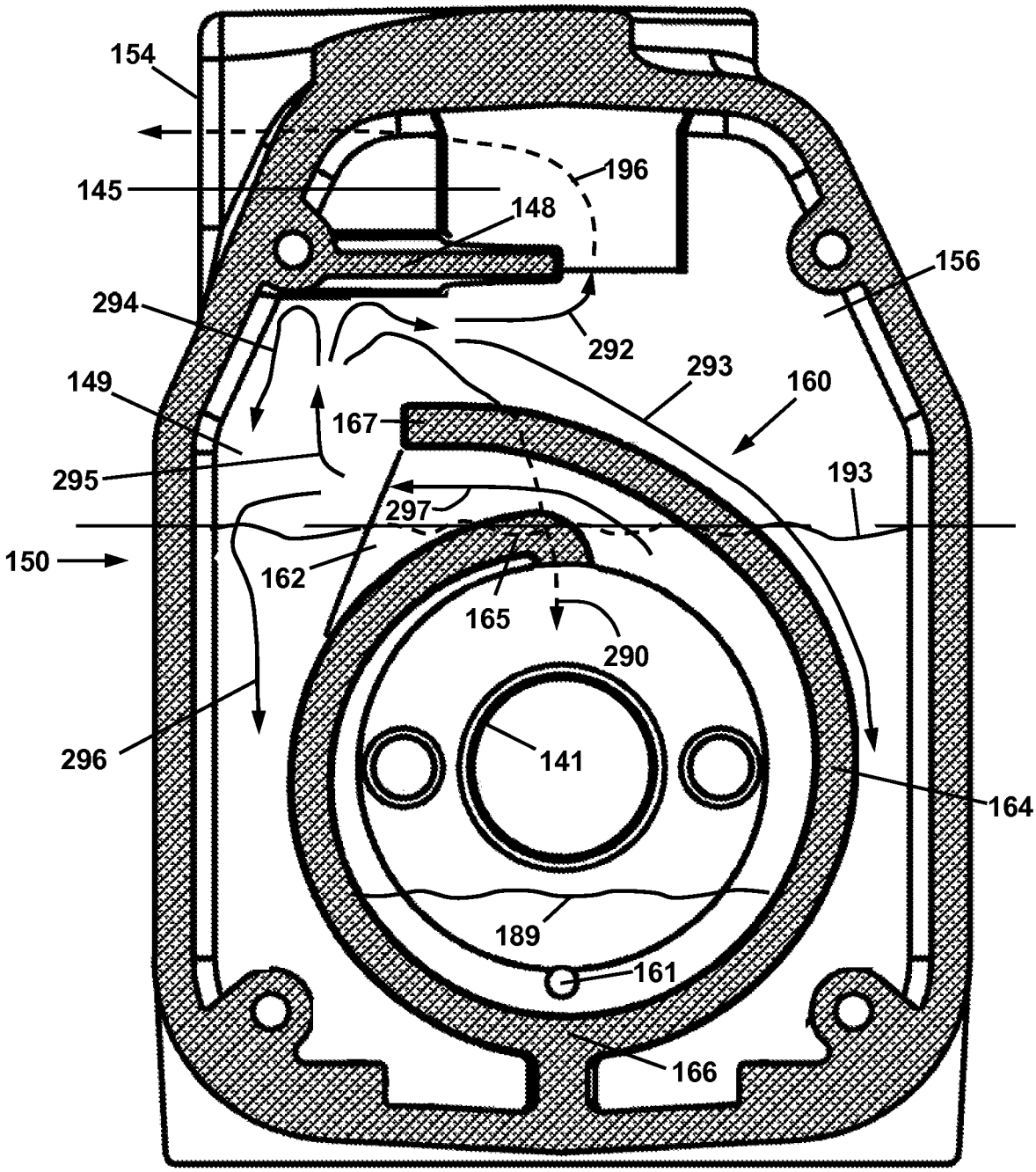
FIG. 11 is a cross sectional view of the pump cavity of the pump housing during self-priming operation, taken along line 6-6 of FIG. 3.

With cavity 156 adequately flooded, the pump motor is started, beginning the self priming operation. FIG. 9 is an enlarged cross sectional view of the pump cavity depicted in FIG. 5, showing additional detail within the pump volute, as well as liquid flow that occurs during self-priming operation. FIG. 11 is a cross sectional view of the pump cavity of the pump housing during self-priming operation, taken along line 6-6 of FIG. 3. For the sake of simplicity of illustration, the pump assembly depicted in FIG. 11 is shown without the pump impeller 210 in place.

Referring to FIGS. 9 and 11, the initial spinning of impeller 210 ejects an initial surge of liquid out of outlet port 154, with liquid level in cavity 156 falling from level 194 (see FIG. 10) to about level 193, whereupon pump 100 achieves a period of pseudo-steady state operation during self-priming. During this period, the liquid level 193 in cavity 156 is maintained relatively constant. However, self priming of the pump occurs due to the recirculation of liquid from pump volute 169 to cavity 156, and back into pump volute 169, and so forth.

Liquid in the lower portion 159 of casing 150 flows through cross port 161 into the lower portion 163 of volute chamber 160 as indicated by path 298. The spinning impeller 210 entrains some of this liquid, and mixes it with air also present within volute 169, and ejects the two phase mix (also referred to herein as froth) out of volute exit flare 162, as indicated by path 297. The froth enters pump cavity 156 in separation region 149, where it is effectively separated into liquid phase that returns by gravity to lower portion 159 of casing 150, and gas phase that exits pump casing 150 through exit port 154. It will be apparent that during this pseudo-steady state operation, pump 100 effectively acts to pump air therethrough, wherein air flows into the pump cover via path 499 (see FIG. 5), and exits out of outlet port 154.

The presence of liquid in volute 169, the kinetic energy imparted thereto by impeller 210, and the creation of froth therefrom with a substantial gas phase component results in the movement of air through pump 100. Pump 100 thus creates a vacuum that serves to draw in liquid from a source, filling a supply pipe (not shown) that is connected to inlet port 412. The self-priming operation occurs until the supply pipe is completely filled, and the pump becomes re-flooded or primed with liquid, at which point steady state pumping operation resumes. In the preferred embodiment, pump 100 is capable of generating at least about 15 feet of water suction head to achieve self priming.

The internal configuration of the separation region 149 of pump cavity 156 provides effective separation of the froth into liquid phase that returns to lower portion 159 of casing 150, and gas phase that exits casing 150 through port 154. Without wishing to be bound to any particular theory, and referring to FIG. 11, applicant believes that a denser portion of the froth quickly separates into liquid and gas, and some of such liquid returns to lower portion 159 as indicated by path 296. Applicant further believes that a less dense portion of the froth is redirected generally upwardly as indicated by path 295, whereupon it impinges upon baffle 148 and achieves further separation into liquid and gas phase. Such liquid phase may flow down the walls of cavity 156 as indicated by path 294, or such phase may fall through cavity 156 around or onto volute chamber 160, as indicated by path 293, both paths 294 and 293 being downwardly towards lower portion 159 of casing 150. The separated gas phase exits cavity 156 as indicated by path 292, and then exits pump 100 from port 154. Applicant further believes that the level of the liquid phase in pump cavity 156 during self priming may be as high as is indicated by level 193, but such level may be lower depending upon the particular operating conditions and liquid being pumped. Applicant further believes that the level of the liquid in volute 169 resulting from flow through port 161 is approximately at level 189 of FIG. 9.

The configuration of applicant's pump casing further provides superior lubrication and cooling of the pump shaft seal during self priming operation. Referring again to FIG. 11, volute chamber 160 is an integral part or pump casing 150. Volute chamber 160 is joined to the inner wall 140 of pump casing by an annular extension 141 therefrom. (See also FIG. 11.) Annular extension 141 comprises a first counterbore 142 at the inner end thereof, in which is housed motor shaft bearing 316. Annular extension 141 further comprises a second counterbore 143 at the outer end thereof, in which is fitted the static portion 321 of pump seal 320.

Static seal portion 321 is preferably held in counterbore 143 by an interference fit, and is hence immobilized therein. Pump seal 320 further comprises dynamic portion 322, which is joined to motor shaft 314, preferably by an interference fit thereto. Hence dynamic portion 322 of pump seal 320 rotates with shaft 314 during pump operation, and there is a ring-shaped region 144 of sliding contact between the rotating surface of dynamic portion 322 of pump seal 320, and the stationary surface of static portion 321 of seal 320. Such a liquid seal configuration is well known in the sealing art.

Referring again to FIG. 11, and in the preferred embodiment, the structure of volute chamber 160 is made stronger by the provision of a web 147 of material near the bottom portion of volute chamber 160, which further rigidly joins volute chamber 160 thereto, and by the provision of a web 146 of material, which further rigidly joins volute chamber 160 to wall 140 of casing 150.

It is important that pump seal 320 be provided with liquid at all times during pump operation, in order to prevent seal failure. Such liquid provides lubrication and cooling to the mating surfaces of dynamic portion 322 of pump seal 320, and static portion 321 of seal 320, thereby reducing the friction and heat buildup therebetween. Referring again to FIG. 9, during steady state operation of pump 100, such provision of liquid occurs because port 161 allows liquid to flow from pump cavity 156 into volute 169, but at a restricted rate. Leakage through an annular gap 291 between motor shaft 312 and exclusionary plate 170 also occurs at a restricted rate, resulting in liquid level 193 in pump cavity being maintained higher than pump seal 320.

Referring also to FIG. 8, exclusionary plate 170 is joined to a flat circular surface or flange 168 of the inner wall of volute chamber 160 by screws 171 and 172. Exclusionary plate serves to only allow a slow leakage of liquid through annular gap 291, so that during steady state operation, pump seal 320 is flooded, but impeller 210 is not in substantial communication with the liquid proximate to seal 320, and is thus not wasting energy mixing or moving such liquid. This arrangement renders pump 100 more efficient.

During self-priming operation, features of the applicant's pump ensure that seal 320 is provided with lubricating and cooling liquid. Referring again to FIGS. 9 and 11, during self-priming, a portion of the liquid phase separated from the froth discharged from volute 169 falls downwardly along path 290, between the upper rear wall 179 of volute chamber 160 and wall 140 of casing 150. Annular region 141 of casing 150 is further provided with an upper passageway 174 into seal flood region 175 and a lower passageway 176 out of seal flood region 175. Thus during self priming operation, liquid falling along path 290 flows around web 146, and further flows along path 289 through upper passageway 174. Such liquid flowing along path 289 directly impinges upon and floods seal 320, thereby providing lubrication and cooling during self priming. Applicant believes that the location and, in a preferred embodiment, the cylindrical shape of web 146 further serves to coalesce liquid thereupon, and then direct such falling liquid into upper passageway 174.

Figure 12:
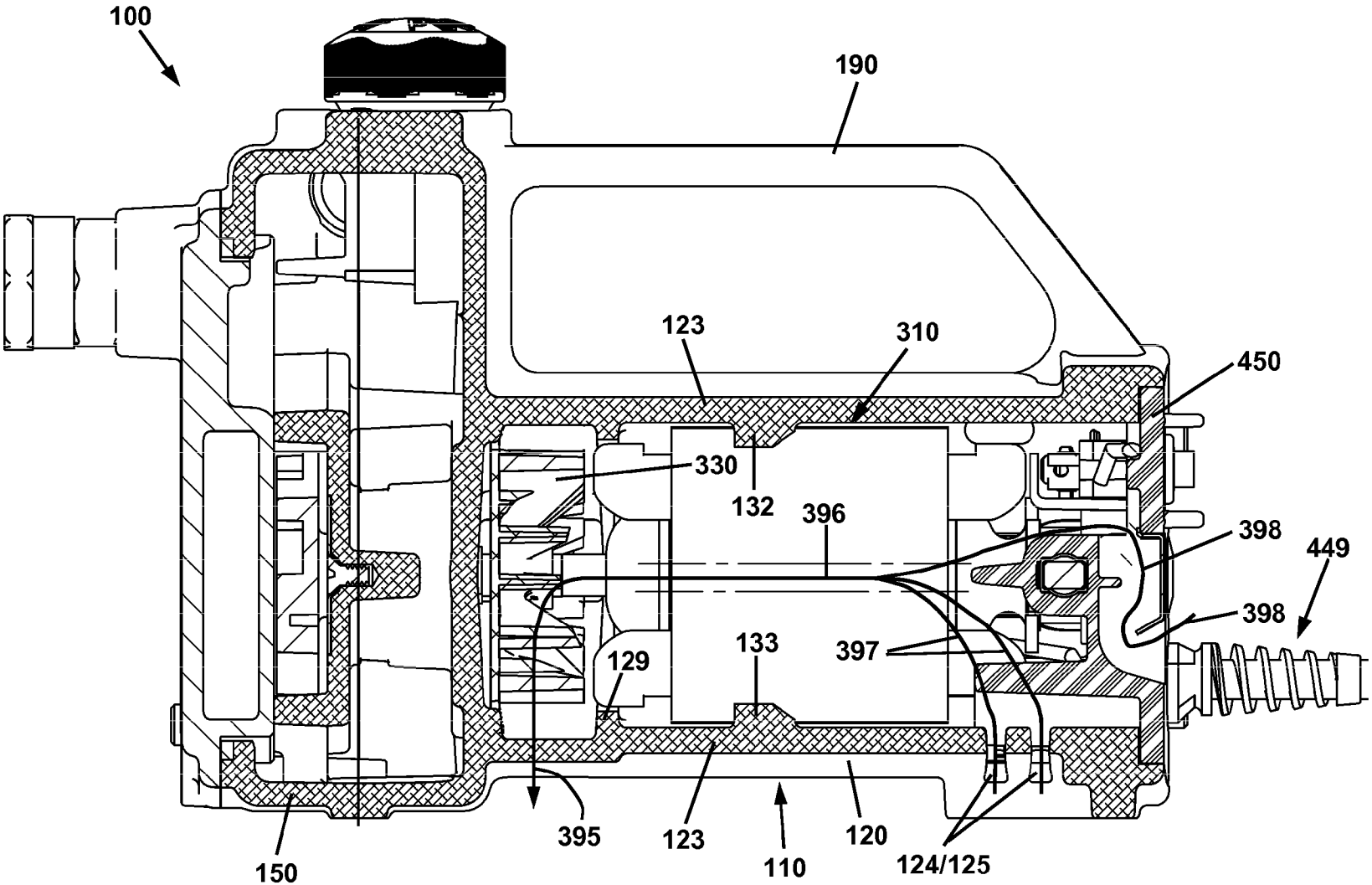
FIG. 12 is a side cross sectional view of the pump motor and housing cavity taken along line 12-12 of FIG. 2.
Figure 13:
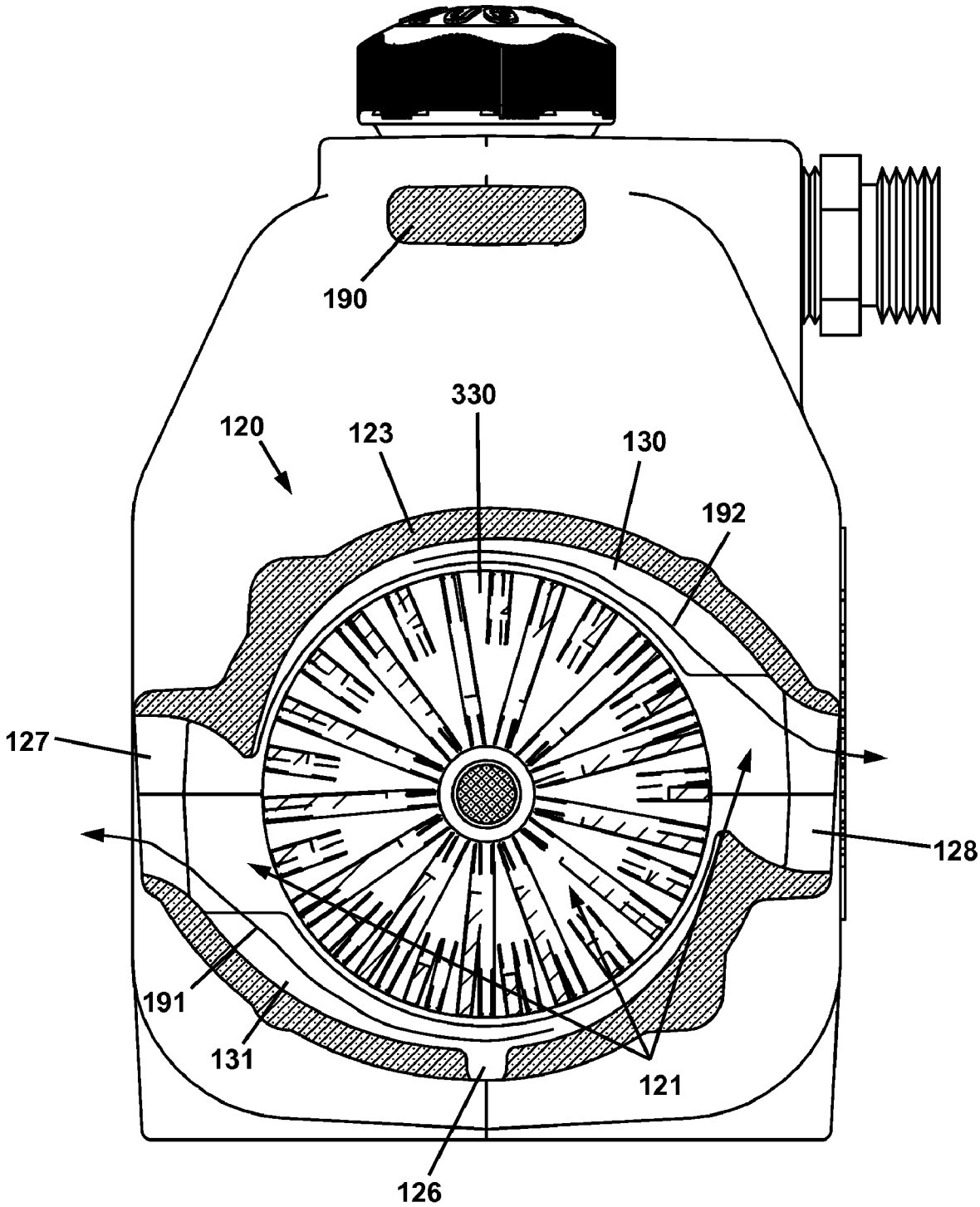
FIG. 13 is an axial cross sectional view of the pump housing and cooling fan of the pump, taken along line 13-13 of FIG. 3.
Figure 14:
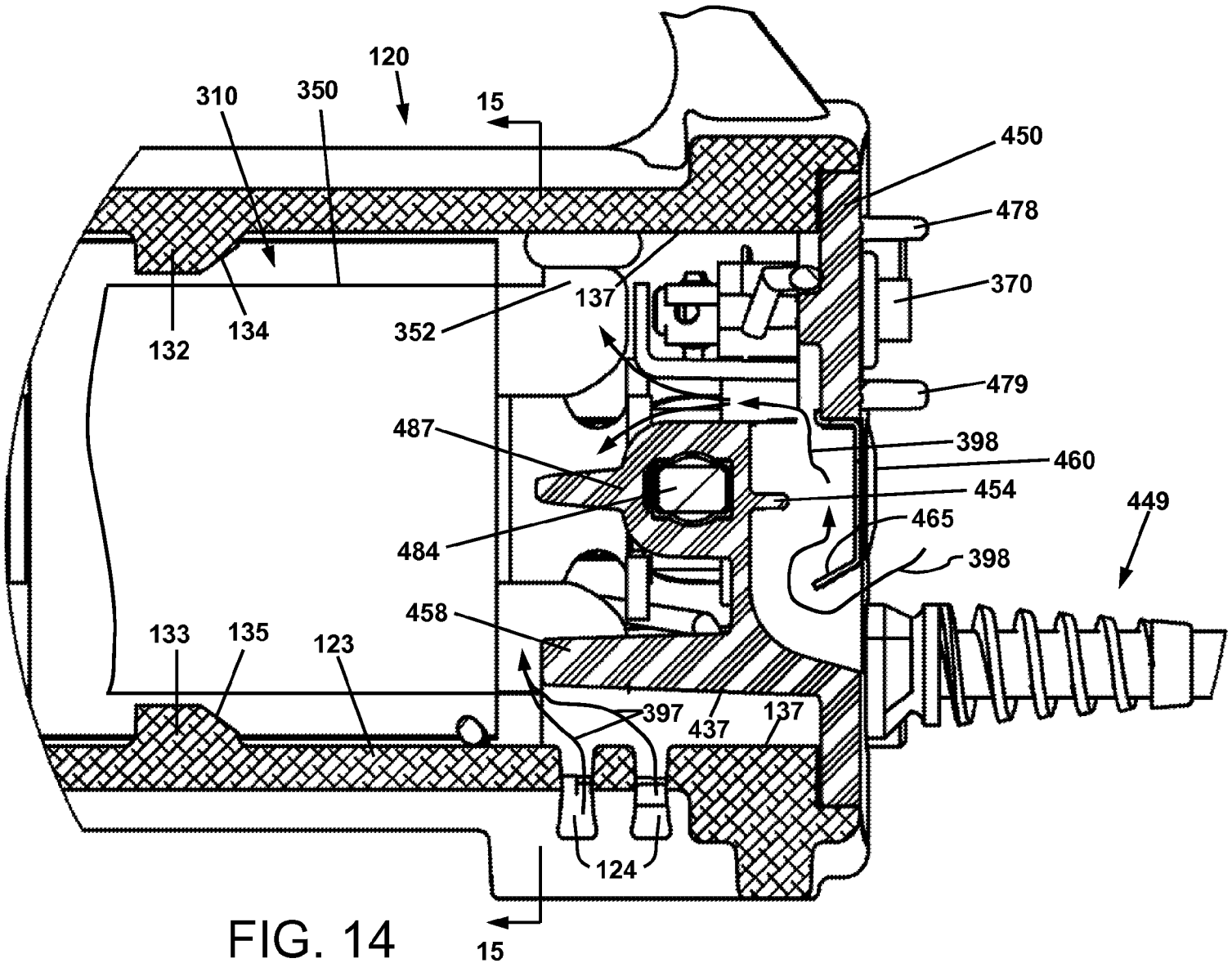
FIG. 14 is a detailed side cross-sectional view of the rightward portion of FIG. 12, depicting the end of the pump that comprises a housing cover, and electrical controls, connections, and motor components.
Figure 15:
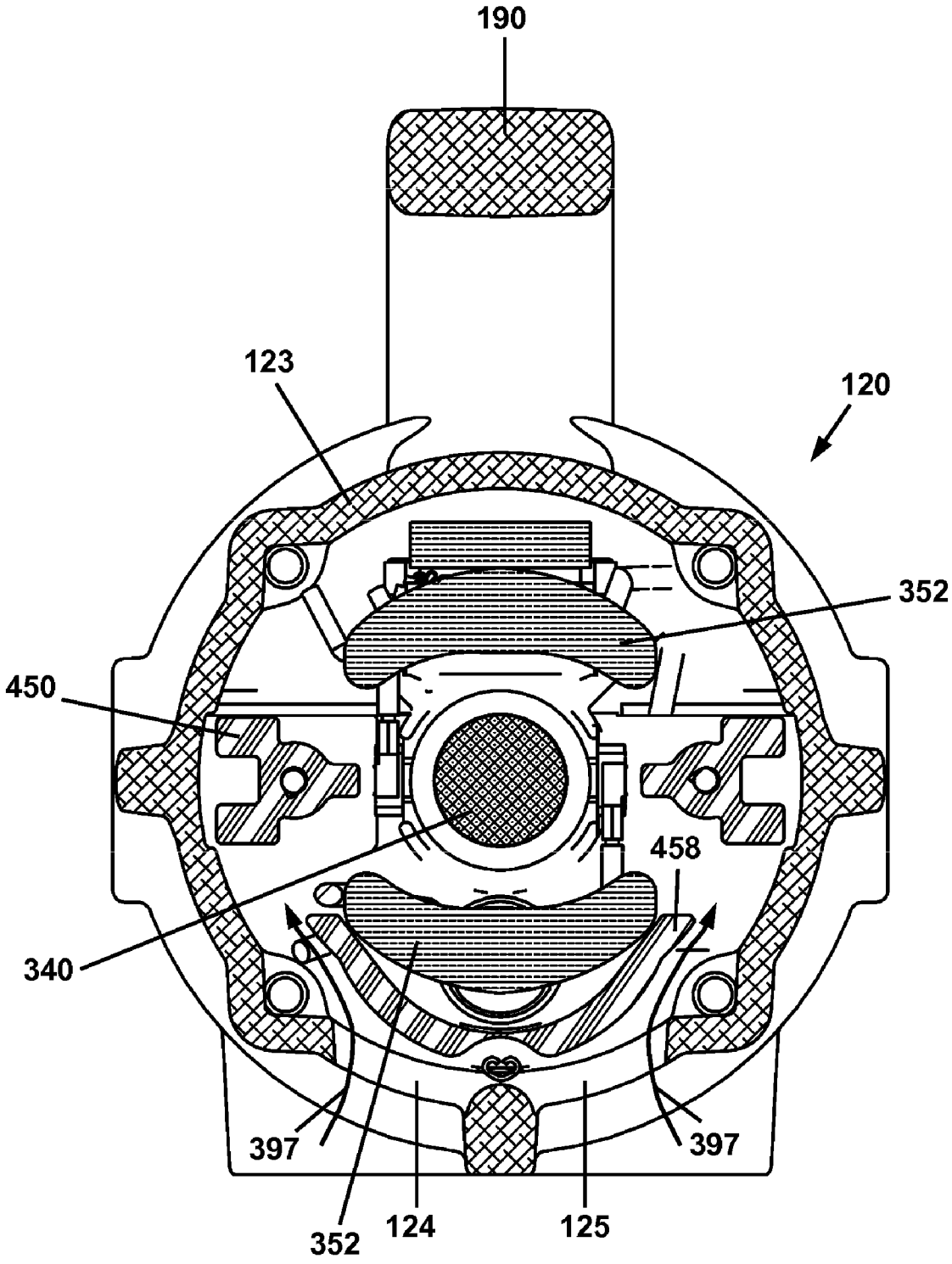
FIG. 15 is an axial cross sectional view of the pump housing and outer end of the pump motor, taken along line 15-15 of FIG. 3.
Figure 16:
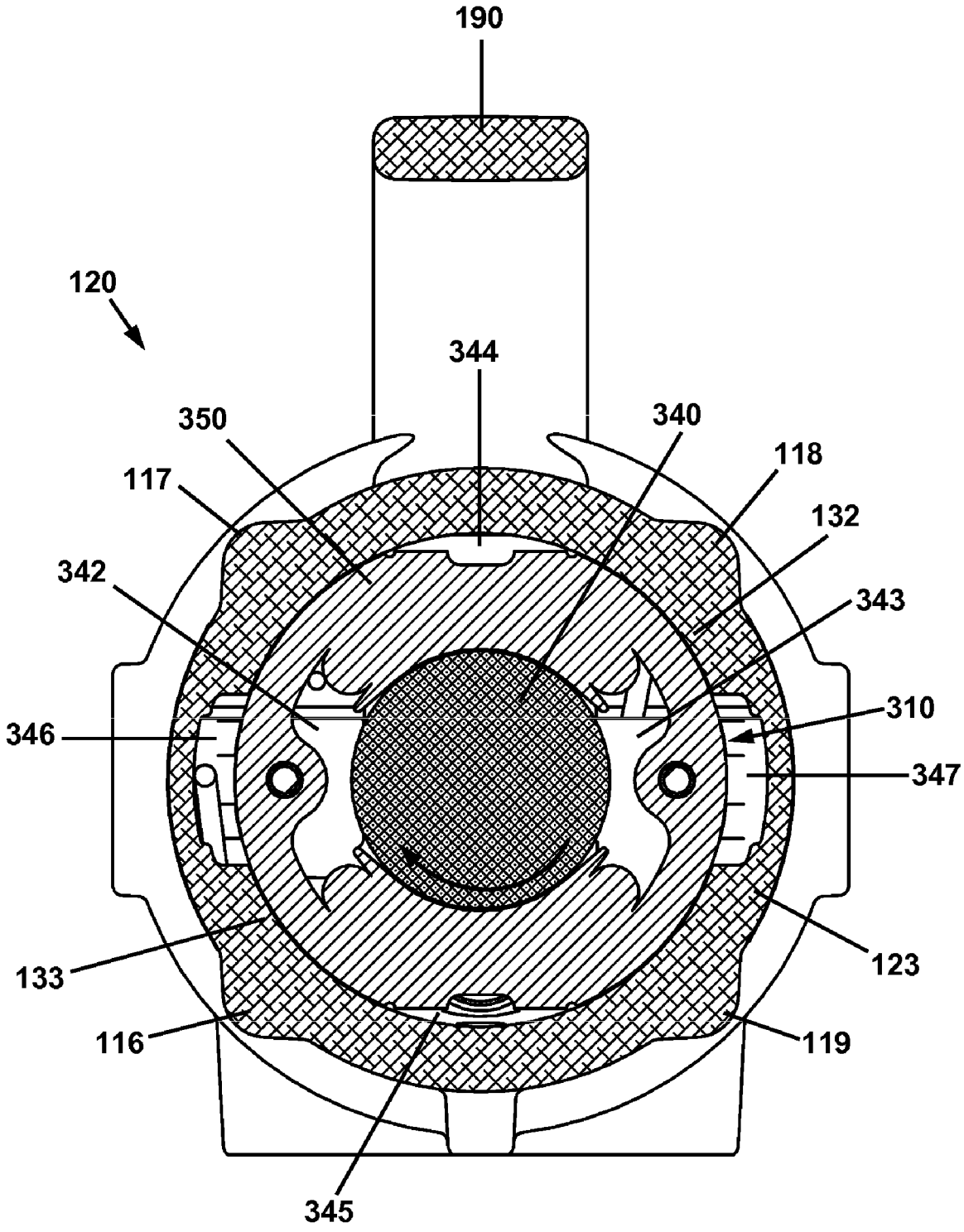
FIG. 16 is an axial cross sectional view of the pump housing and central section of the pump motor, taken along line 16-16 of FIG. 3.
Figure 17B:
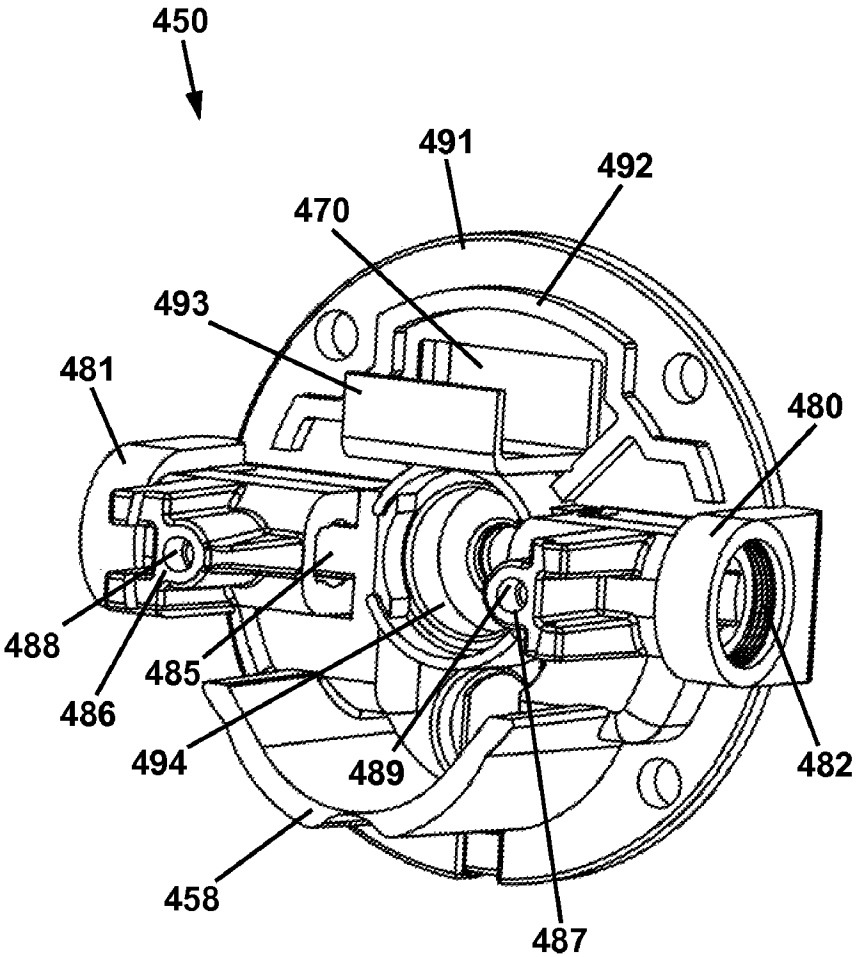
FIG. 17B is a perspective view of the inside of the preferred one-piece motor housing cover of FIG. 17A.
Figure 17A:
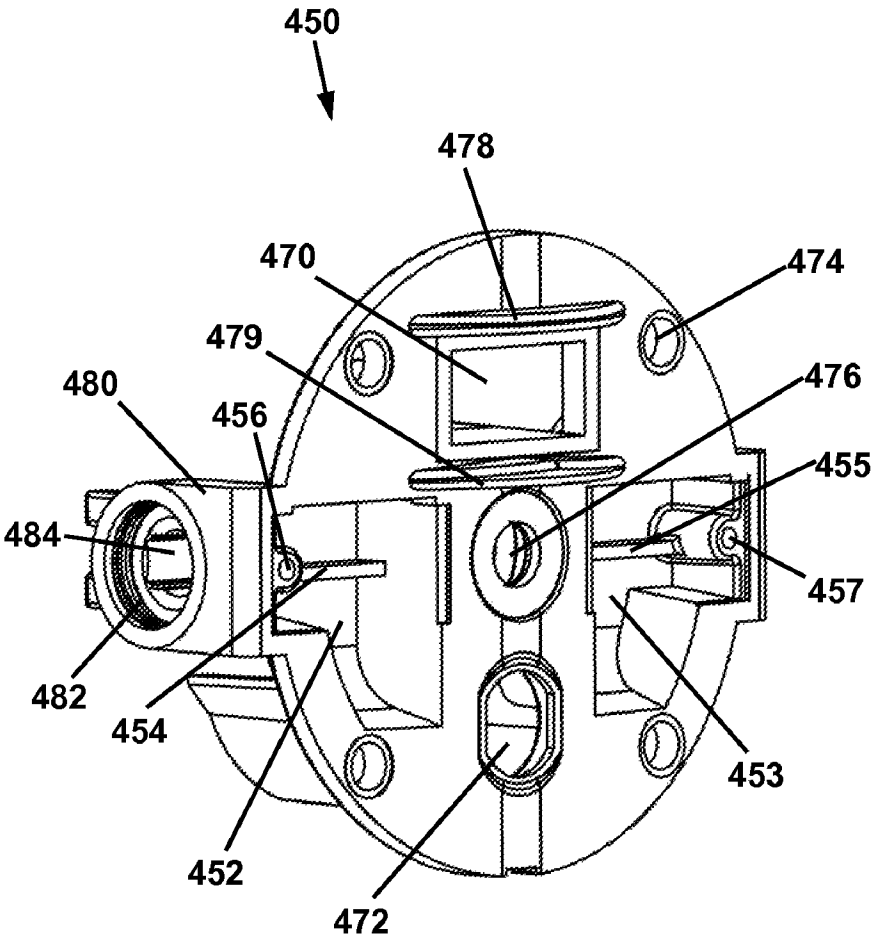
FIG. 17A is a perspective view of the outside of a preferred one-piece motor housing cover of the applicant's transfer pump.
Figure 18:
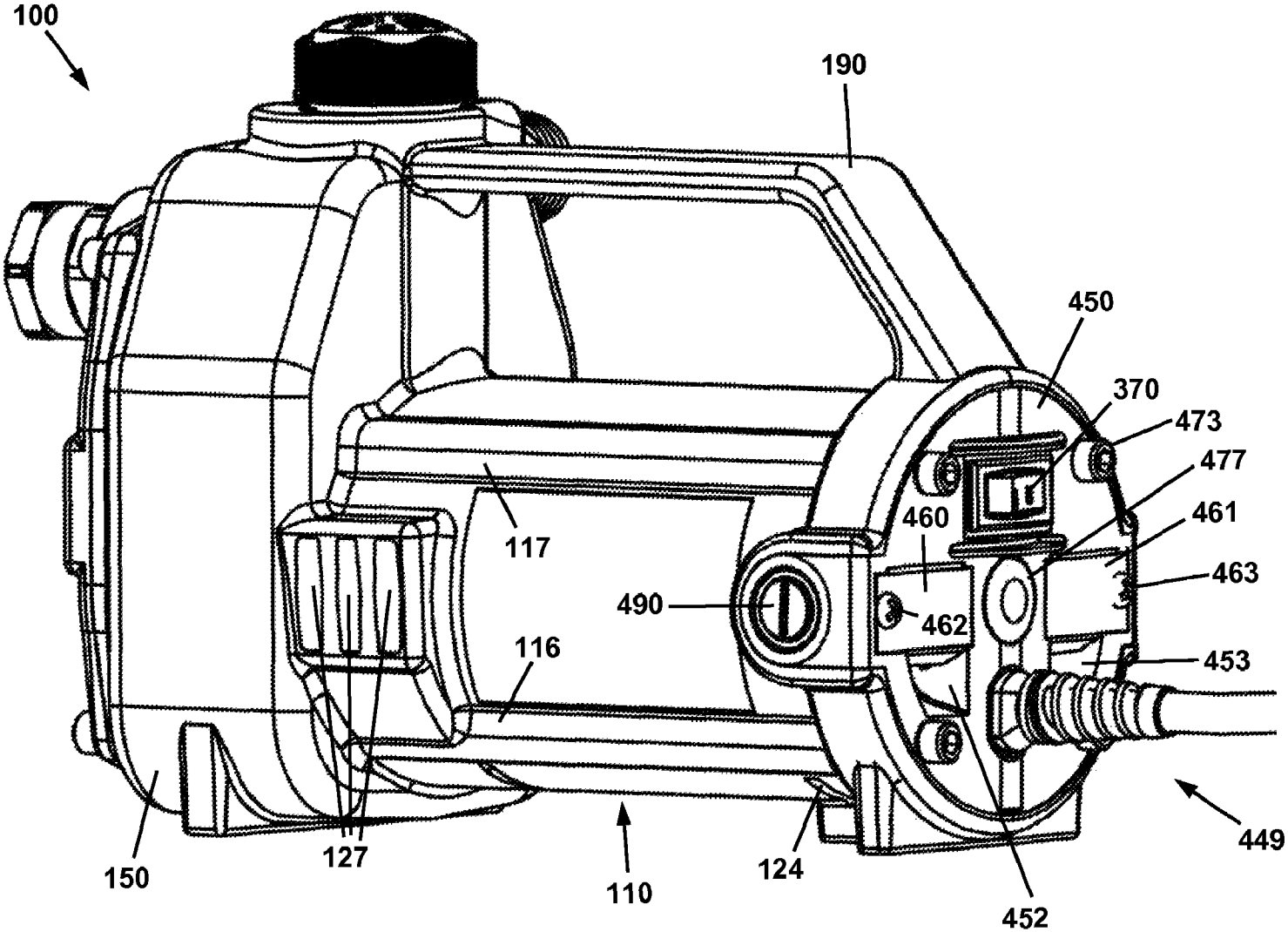
FIG. 18 is a rear perspective view of the transfer pump of the present invention, depicting the motor housing cover of FIGS. 17A and 17B fitted thereto
Figure 19:
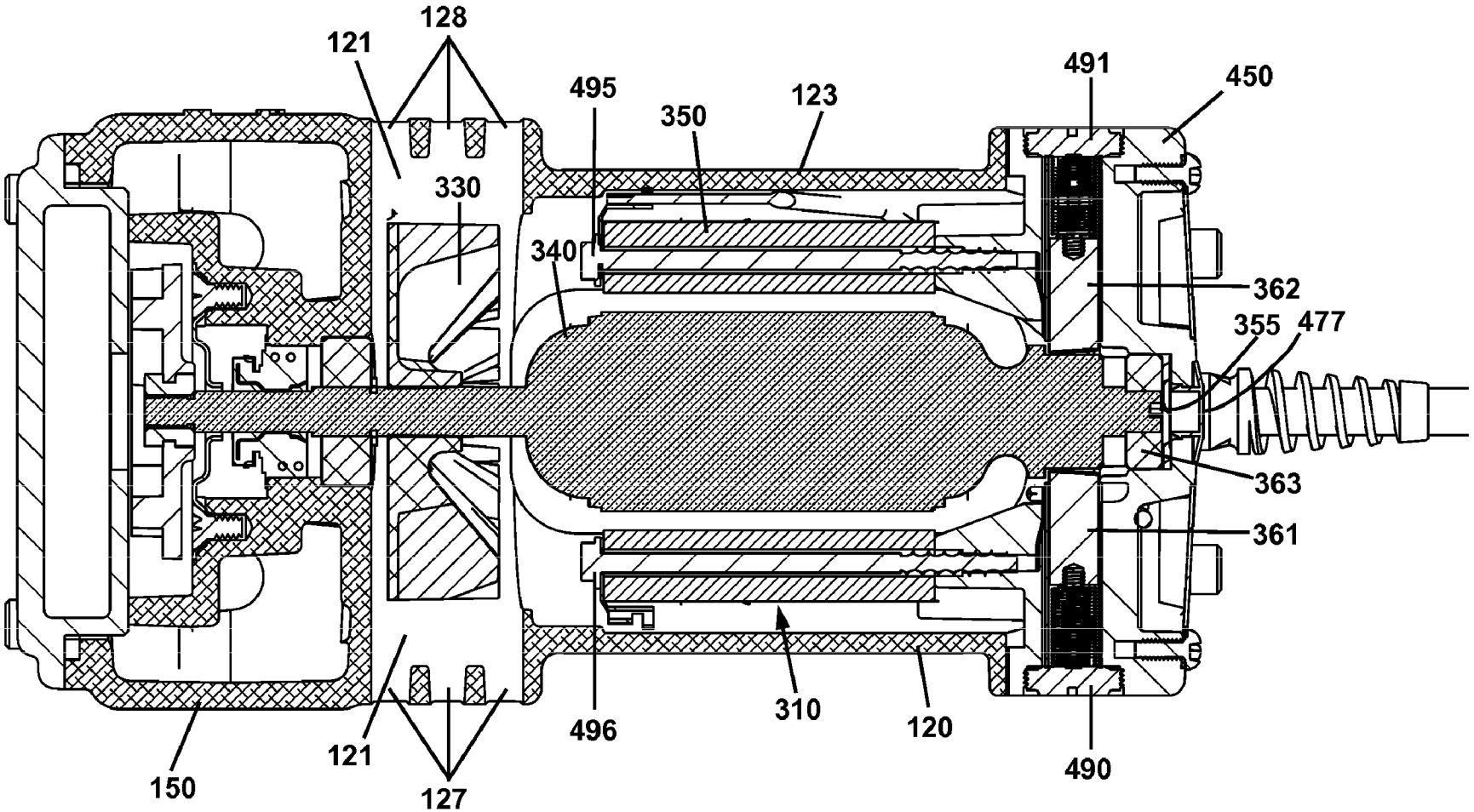
FIG. 19 is a top cross sectional view of the transfer pump of the present invention, taken along lines 19-19 of FIG. 2.

In a preferred embodiment, the applicant's transfer pump comprises a unitary housing having numerous beneficial features that provide superior strength, portability, cooling of components therein, and protection of components therein from adverse elements such as e.g. rain, or other splashed water. FIGS. 12-16 are provided in order to fully depict the beneficial features of the preferred pump housing. FIG. 12 is a side cross sectional view of the pump motor and housing cavity taken along line 12-12 of FIG. 2; FIG. 13 is an axial cross sectional view of the pump housing and cooling fan of the pump, taken along line 13-13 of FIG. 3; FIG. 14 is a detailed side cross-sectional view of the rightward portion of FIG. 12, depicting the end of the pump that comprises a housing cover, and electrical controls, connections, and motor components; FIG. 15 is an axial cross sectional view of the pump housing and outer end of the pump motor, taken along line 15-15 of FIG. 3; FIG. 16 is an axial cross sectional view of the pump housing and central section of the pump motor, taken along line 16-16 of FIG. 3; FIG. 17A is a perspective view of the outside of a preferred one-piece motor housing cover of the applicant's transfer pump; FIG. 17B is a perspective view of the inside of the preferred one-piece motor housing cover of FIG. 17A; FIG. 18 is a rear perspective view of the transfer pump of the present invention, depicting the motor housing cover of FIGS. 17A and 17B fitted thereto; and FIG. 19 is a top cross sectional view of the transfer pump of the present invention, taken along lines 19-19 of FIG. 2.

Referring first to FIG. 12, housing 110 comprises a first portion 120 that is generally cylindrical and that houses a motor 310, a second casing portion 150 within which is formed a pump cavity, and a handle 190. Second casing portion 150 and handle 190 of housing 110 have been described in detail previously in this specification. The following description will be directed mainly to the structures of housing first portion 120, motor housing cover 450, and the components therein that provide the aforementioned beneficial features.

One beneficial feature of the applicant's pump 100 is cooling capability provided to the motor 310 and electrical components therein. Housing portion 120 and housing cover 450 are provided with passageways that individually and in combination allow airflow proximate to motor 310 and electrical components connected thereto. Referring again to FIG. 12, electric motor 310 is preferably provided with a fan 330 operatively attached to motor shaft 312 (see FIG. 9), in order to provide pumping of cooling air through housing portion 120. General airflow pathways through housing portion 120 are depicted in FIG. 12. Air enters through rear cover 450 along pathway 398, and through bottom slots 124/125 in the wall 123 of housing portion 120. Air flows axially along path 396 through passageways to be described subsequently, is accelerated by fan 300, and discharged radially out of housing through path 395 out of a bottom slot 126, left slots 127, and right slots 128 in housing portion 120. (See also FIGS. 13 and 18.)

In the preferred embodiment, fan 330 is a fan having vanes optimally formed to efficiently draw air along the axis thereof and direct it radially. FIG. 13 is an axial cross sectional view of pump that depicts housing section 120 and cooling fan 330 disposed therein. Referring to FIG. 13 and to FIG. 19, it can be seen that at this axial location along housing portion 120, housing wall 123 is formed into an overall volute cavity 121 within which is disposed fan 330. Volute cavity 121 preferably has a double volute shape for the effective discharge of air from within housing portion 120 by fan 330. Housing portion 120 comprises an upper volute 130 and a lower volute 131.

In operation, fan 330 accelerates air from the axial region thereof radially outwardly, discharging air generally along path 192 out of right slots 128, and along path 191 out of left slots 127. To a small extent, air is also discharged out of bottom slot or hole 126. However, bottom slot 126 is primarily intended as a drain hole, providing rapid drainage from housing portion 120 in the event that any water has somehow entered housing portion 120. To this end, housing portion 120 is further provided with a circumferential ridge 129 (see FIG. 12) formed on the inside of housing wall 123 proximate to volute cavity 121 in order to capture and direct any accumulated water out of slot 126. The overall double volute housing shape and drainage slot provides efficient discharge airflow while also reducing the likelihood of any water entering the housing, and facilitating the discharge of such water if it does enter the housing.

FIG. 14 is a detailed side cross-sectional view of the rightward portion of FIG. 12, depicting the end of the pump that comprises a housing cover, and electrical controls, connections, and motor components; FIG. 15 is an axial cross sectional view of this region of pump housing section 120, motor 310, and cover 450, taken along line 15-15 of FIG. 14. Referring to FIGS. 14 and 15, and also to FIGS. 17A, 17B, and 18, which depict motor housing cover 450 separately and in the installed state, cooling air enters housing portion 120 through slots 124 and 125 along path 397, and through left opening 452 and a right opening 453 in cover 450 along path 398.

Path 398 is a labyrinth-shaped path, preferably formed by the combination of left and right horizontal baffles or ribs 454 and 455 formed in cover 450, and cover plates 460 and 461, which are secured to cover 450 with screws 462 and 463 engaged with holes 456 and 457. A preferred shape of cover plates 460 and 461 is depicted in FIG. 14, wherein cover plate 460 is formed to engage with left opening 452. Cover plate 460 further comprises a lower lip 465 that is bent inwardly, thereby forming labyrinth-shaped path 398 with rib 454 in cover 450, which is effective in permitting air flow therethrough, while preventing the entry or entrainment of any splashed water on cover 450. In the preferred embodiment, cover plates 460 and 461 are formed from stampings of thin stainless steel.

Referring again to FIGS. 14, 15, and 17B, lower pathway 397 is also a labyrinth-shaped path, formed by the combination of a large arcuate rib 458 formed in cover 450, and the wall 123 of housing portion 120 proximate thereto. Rib 458 and housing wall 123 are thus also effective in permitting air flow along path 397, while preventing the entry or entrainment of any splashed water on housing 110. The cooling air that enters housing portion 120 through paths 398 and 397 flows over armature 340 and windings 352 of stator 350 of motor 310, thereby cooling these components.

The air entering along paths 397 and 398 continues to flow axially along motor 310, as can be seen in FIG. 16. Air flows within motor 310 through axial passageways 342 and 342 formed between armature 340 and stator 350. Air also flows axially along several passageways formed between housing wall 123 and stator 350. Upper and lower passageways 344 and 345 are formed between flats on stator 350 and the curved inner surface of housing wall 123. Right and left passageways 346 and 347 are formed by the provision of upper arcuate rib 132 and lower arcuate rib 133 in housing wall 123.

The preferred structure of ribs 132 and 133 is best viewed in conjunction with FIGS. 13 and 14. Referring to FIGS. 13, 14, arcuate ribs 132 and 133 are disposed in the central region of housing portion 120. Upper arcuate rib 132 preferably extends from about the 10 o'clock position to about the 2 o'clock position on the inside of housing wall 123, and lower arcuate rib 133 preferably extends from about the 8 o'clock-position to about the 4 o'clock position on the inside of housing wall 123. Thus left passageway 346 is formed between the 8 o'clock edge of lower rib 133 and the 10 o'clock edge of upper rib 132, and right passageway 347 is formed between the 4 o'clock edge of lower rib 133 and the 2 o'clock edge of upper rib 132. The provision of such arcuate upper and lower ribs and the passageways therebetween thus enable axial airflow along and around nearly the entire outer surface of stator 350, while still providing housing portion 120 with superior structural strength.

In an alternative embodiment, housing wall may be provided with a single arcuate rib extending nearly completely around the interior of wall 123, with a single passageway formed between the ends thereof. However, for more uniform airflow, at least two arctuate ribs and at least two passageways therebetween are preferred as depicted in FIG. 16.

Referring again to FIG. 14 and in the preferred embodiment depicted therein, upper rib 132 and lower rib 133 are preferably provided with bevels 134 and 135. These bevels facilitate installation of the stator 350 into the housing portion 120, guiding and centering stator 350 in housing portion 120 as it is slid into position therein. The inner surfaces of upper and lower ribs 132 and 133 are also preferably nearly in touching contact with stator 350 when stator 350 is installed in housing portion 120 as depicted in FIG. 14, so that such inner surfaces can provide support to stator 350 in the event that pump 100 is dropped or otherwise jolted during operation.

In the preferred embodiment of the applicant's transfer pump, housing portion 120 is made with additional features to provide additional structural strength thereof. Referring to FIGS. 16, and 18, housing portion 120 of pump 100 is provided with axial ribs 116, 117, 118, and 119 formed in the wall 123 thereof. Axial ribs 116, 117, 118, and 119 are preferably spaced at 90 degree intervals around the circumference of housing portion 120. Housing portion 120 may further comprise rubber feet (not shown) fitted within holes (not shown) on the lowermost surfaces of housing 120. In a further embodiment (not shown) housing 110 comprises a weep hole formed in annular extension 141, beneath the bearing race holding bearing 142. (See FIG. 9.)

In the preferred embodiment of the applicant's transfer pump, housing cover 450 is also made with numerous additional features to provide additional structural strength, resistance to adverse elements, and ease of assembly. Referring to FIGS. 14, 17A, 17B, 18 and 19, cover 450 is provided with hole 470 for the fitting and sealing of switch 370; hole 472 for the fitting and sealing of cord assembly 449; holes 474 for the passage of screws 473 therethrough and the engagement of cover 450 to housing 110; and hole 476 for the fitting of shaft cap 477. Shaft cap 477 is fitted to hole 476 with a light interference fit, and is easily removed therefrom for access to the outboard end of motor shaft 312 (see FIG. 9). In the preferred embodiment, the outboard end of motor shaft 312 is provided with a slot 355 or alternatively a hex socket for engagement with a screwdriver or hex key. Thus the shaft 312 of pump 100 may be externally driven by hand or by a power tool in the event that such action is needed for troubleshooting where the pump 100 is in use.

Referring again to FIGS. 17A, 17B and 19, cover 450 preferably comprises protective upper rib 478 and protective lower rib 479, for protection of switch 370 installed in hole 470. Cover 450 further comprises left ear 480 and right ear 481 having right threaded bore 482 and left threaded bore (not shown). Cover 450 further comprises rectangular slots 484 and 485 for housing the motor brushes (not shown) and gusseted extensions 486 and 487, in which are provided holes 488 and 489. Stator 350 of motor 310 is fastened to cover 450 by engagement of threaded fasteners 495 and 496 (FIG. 19) with holes 488 and 489. Referring to FIG. 18, caps 490 are engaged in left threaded bore 482 and right bore (not shown) to seal and hold the motor brushes 361 and 362 therein. In a further embodiment, rectangular slots 484 and 485 could be formed with semicircular ends, i.e. a combination of semicircle-rectangle-semicircle to accommodate motor brushes with a corresponding shape; or slots 484 and 485 could be made of another shape as required to match another particular brush shape.

Referring again to FIG. 17B, cover 450 preferably further comprises a flat flange 491 for engagement with housing 110, and a raised rib 492 proximate thereto for added structural strength. Cover 450 may further comprise an L-shaped bracket or shelf 493 for support and isolation of wiring attached to switch 370 from the nearby motor windings and to shield the wiring terminals of switch 370 from carbon dust resulting from motor brush wear. Cover 450 further comprises a bearing race 494, for housing the outboard bearing 363 of electric motor 310 and four small nubs that act to center the field of motor 310.

Cover 450 may be formed from any suitable structurally strong and electrically insulating material, with it being preferred that such material is also heat resistant, flame resistant, light in weight and formable by casting or molding to net shape. In one preferred embodiment, cover 450 consists essentially of a polymer-glass fiber composite material, and in particular, of Lupox 5303, which is a glass fiber reinforced PBT Polybutylene Terephthalate, Referring to FIG. 14, the inner surface of wall 123 of housing portion 120 is provided with a taper 137. Features formed on the inner surface of cover 450, such as arcuate rib 458 are also provided with a corresponding taper 437 of substantially the same pitch as taper 137 of housing portion 120. In one embodiment, the pitch of the taper is approximately 3 degrees of angle with respect to the central axis of motor 310 and housing portion 120. It can be seen from FIGS. 12, 14, 18, and 19 that cover 450 and the features thereof are well protected from impact in the event that pump 100 is dropped or roughly handled. Screws 473 provide additional protection to cover 450, transferring impact at the rear of the pump into housing portion 120.

Thus the cover 450 and the housing 110 of the applicant's pump, with the many features recited in the foregoing description, provides structural strength, resistance to adverse elements, electrical connectivity, and ease of assembly in the combination of simple one-piece parts.

It is, therefore, apparent that there has been provided, in accordance with the present invention, a portable self-priming transfer pump comprising a one piece unitary housing, comprised of a first portion that houses a motor, a second casing portion within which is formed a pump cavity, and a handle; and a one piece cover fitted to the outboard end of the second portion of the housing. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A liquid transfer pump comprising:

a. a housing formed of a single unitary part;

b. a motor disposed within a first portion of said housing, said motor including a rotatable drive shaft;

c. a pump cavity formed in a second portion of said housing, said cavity having an open end and an outlet port;

d. a volute chamber having an open end, said volute chamber formed within said pump cavity;

e. a rotatable impeller disposed within said volute chamber and operatively engaged with said rotatable drive shaft of said motor;

f. a cover attached to said open end of said pump cavity and engaged with said open end of said volute chamber to form a volute; and g. an annular region formed in said housing within said pump cavity, said annular region comprising a counterbore within which is disposed a seal, said annular region enclosing a seal flood region, and said annular region including an upper passageway between said pump cavity and said seal flood region and a lower passageway between said pump cavity and said seal flood region, both of said upper passageway and said lower passageway being formed as a part of said housing.

2. The liquid transfer pump as recited in claim 1, further comprising an exclusionary plate disposed between said volute chamber and said annular region, said rotatable drive shaft of said motor extending through a hole formed in said exclusionary plate.

3. The liquid transfer pump as recited in claim 1, wherein said volute comprises an exit flare.

4. The liquid transfer pump as recited in claim 3, wherein said pump cavity further comprises a baffle disposed above said exit flare of said volute.

5. The liquid transfer pump as recited in claim 1, wherein said cover comprises an inlet port, a cavity, and an outlet port proximate to said impeller.

6. The liquid transfer pump as recited in claim 5, wherein said cover further comprises an inner face, said impeller further comprises a vane face, and said inner face of said cover and said vane face of said impeller are substantially parallel to each other.

7. The liquid transfer pump as recited in claim 1, wherein said second portion of said housing further comprises a filling port comprising a threaded bore.

8. The liquid transfer pump as recited in claim 7, wherein said filling port further comprises a funnel shape disposed above said threaded bore.

9. The liquid transfer pump as recited in claim 8, further comprising a threaded plug engaged with said threaded bore.

10. The liquid transfer pump as recited in claim 9, wherein said plug further comprises a seal engaged with said filling port.

11. The liquid transfer pump as recited in claim 1, wherein said unitary housing further comprises a handle.

12. The liquid transfer pump as recited in claim 1, wherein said housing is formed of aluminum alloy.

13. The liquid transfer pump as recited in claim 1, further comprising:

a. said motor disposed within a first substantially cylindrical portion of said housing; said first portion of said housing comprising an open end, a first air inlet opening and a first air outlet opening;

b. said pump cavity formed in a second portion of said housing; and c. said cover attached to said open end of said first portion of said housing.

14. The liquid transfer pump as recited in claim 13, wherein said motor further comprises a fan operatively engaged to said rotatable drive shaft.

15. The liquid transfer pump as recited in claim 14, wherein said substantially cylindrical portion of said housing comprises a volute cavity.

16. The liquid transfer pump as recited in claim 15, wherein said volute cavity comprises a first volute and a second volute.

17. The liquid transfer pump as recited in claim 16, wherein said substantially cylindrical portion of said housing comprises a first opening proximate to said first volute and a second opening proximate to said second volute.

18. The liquid transfer pump as recited in claim 17, further comprising a drain hole in the bottom of said volute cavity.

19. The liquid transfer pump as recited in claim 18, further comprising a circumferential ridge proximate to said volute cavity.

20. The liquid transfer pump as recited in claim 13, wherein said cover is unitary.

21. The liquid transfer pump as recited in claim 20, wherein said cover further comprises an inlet opening.

22. The liquid transfer pump as recited in claim 13, wherein said first substantially cylindrical portion of said housing comprises at least one axial rib.

23. The liquid transfer pump as recited in claim 13, wherein said first substantially cylindrical portion of said housing comprises at least one arcuate rib having an end forming a portion of a passageway thereby.

24. The liquid transfer pump as recited in claim 13, wherein said unitary housing further comprises a handle.

25. The liquid transfer pump as recited in claim 13, wherein said housing is formed of aluminum alloy.

26. The liquid transfer pump as recited in claim 1, further comprising:

a. said motor disposed within a first substantially cylindrical portion of said housing; said first substantially cylindrical portion of said housing comprising an open end, and a first air outlet opening;

b. said pump cavity formed in a second portion of said housing; and c. said cover attached to said open end of said first portion of said housing, said cover comprising an outer surface, an inner surface, and a first inlet opening.

27. The liquid transfer pump as recited in claim 26, wherein said motor further comprises a fan operatively engaged to said rotatable drive shaft.

28. The liquid transfer pump as recited in claim 27, wherein said cover further comprises a first cover plate covering a portion of said first inlet opening.

29. The liquid transfer pump as recited in claim 28, wherein said first inlet opening further comprises a first baffle.

30. The liquid transfer pump as recited in claim 29, wherein said cover further comprises a second cover plate covering a portion of a second inlet opening, said second inlet opening comprising a second baffle.

31. The liquid transfer pump as recited in claim 26, wherein said cover further comprises a first ear with a first port and a second ear with a second port.

32. The liquid transfer pump as recited in claim 31, wherein said first port of said first ear comprises a first threaded bore and said second port of said second ear comprises a second threaded bore.

33. The liquid transfer pump as recited in claim 32, further comprising a first motor brush disposed in said first port in said first ear, and a second motor brush disposed in said second port in said second ear.

34. The liquid transfer pump as recited in claim 33, further comprising a first threaded cap disposed in said first port in said first ear, and a second threaded cap disposed in said second port in said second ear.

35. The liquid transfer pump as recited in claim 26, wherein said cover consists essentially of plastic.

36. The liquid transfer pump as recited in claim 26, wherein said cover further comprises a shaft opening.

37. The liquid transfer pump as recited in claim 26, wherein said cover further comprises a switch opening, and said pump further comprises a switch disposed in said switch opening.

38. The liquid transfer pump as recited in claim 26, wherein said cover further comprises a cord opening, and said pump further comprises a cord assembly disposed in said cord opening.

39. The liquid transfer pump as recited in claim 26, wherein said inner surface of said cover further comprises an arcuate rib.

40. The liquid transfer pump as recited in claim 26, wherein said inner surface of said cover further comprises a reinforcement rib.

41. The liquid transfer pump as recited in claim 26, wherein said cover further comprises a flange with at least one hole therethrough.

42. The liquid transfer pump as recited in claim 26, wherein said cover further comprises a bearing race formed therein.

43. The liquid transfer pump as recited in claim 26, wherein said inner surface cover of said cover further comprises a first fastener hole and a second fastener hole.

44. The liquid transfer pump as recited in claim 26, wherein said open end of said first substantially cylindrical portion of said housing cover further comprises a first taper, and wherein said cover further comprises a second taper engaged with said first taper of said open end of said first substantially cylindrical portion of said housing.

45. A liquid transfer pump comprising:

a. a housing formed of a single unitary part;

b. a motor disposed within a first portion of said housing, said motor including a rotatable drive shaft;

c. a pump cavity formed in a second portion of said housing, said cavity having an open end and an outlet port;

d. a volute chamber having an open end, said volute chamber formed within said pump cavity and comprising a wall formed as a part of said housing, wherein a cross port is formed through said wall;

e. a rotatable impeller disposed within said volute chamber and operatively engaged with said rotatable drive shaft of said motor;

f. a cover attached to said open end of said pump cavity and engaged with said open end of said volute chamber to form a volute;

g. an exclusionary plate disposed within said volute chamber, said rotatable drive shaft of said motor extending through a hole formed in said exclusionary plate; and h. an annular region formed in said housing within said pump cavity, said annular region comprising a counterbore within which is disposed a seal, said annular region enclosing a seal flood region, and said annular region including an upper passageway between said pump cavity and said seal flood region and a lower passageway between said pump cavity and said seal flood region, both of said upper passageway and said lower passageway being formed as a part of said housing.

46. A liquid transfer pump comprising:

a. a housing;

b. a motor disposed within a first portion of said housing, said motor including a rotatable drive shaft;

c. a pump cavity formed in a second portion of said housing, said cavity having an open end and an outlet port;

d. a volute chamber having an open end, said volute chamber formed within said pump cavity;

e. an annular region formed in said housing within said pump cavity, said annular region comprising a counterbore within which is disposed a seal, said annular region enclosing a seal flood region, and said annular region including an upper passageway between said pump cavity and said seal flood region and a lower passageway between said pump cavity and said seal flood region, both of said upper passageway and said lower passageway being formed as a part of said housing;

f. a rotatable impeller disposed within said volute chamber and operatively engaged with said rotatable drive shaft of said motor; and g. a cover attached to said open end of said pump cavity and engaged with said open end of said volute chamber to form a volute.

47. The liquid transfer pump as recited in claim 46, further comprising an exclusionary plate disposed within said volute chamber and separating said volute chamber from said annular region within said housing, said rotatable drive shaft of said motor extending through a hole formed in said exclusionary plate, thereby forming an annular gap between said shaft and said hole, said annular gap providing fluid communication between said volute chamber and said annular region within said housing.

48. The liquid transfer pump as recited in claim 46, wherein said volute chamber comprises a wall formed as a part of said housing, and wherein a cross port is formed through said wall of said volute chamber.

* * * * *